US007973741B2

(12) United States Patent
Tsuchida et al.

(10) Patent No.: US 7,973,741 B2
(45) Date of Patent: Jul. 5, 2011

(54) PLASMA DISPLAY DEVICE AND METHOD FOR DRIVING THE SAME

(75) Inventors: Shinya Tsuchida, Kagoshima Prefecture (JP); Shinji Hirakawa, Kagoshima Prefecture (JP); Mitsuhiro Ishizuka, Kagoshima Prefecture (JP); Koji Hashimoto, Kagoshima Prefecture (JP); Hajime Homma, Kagoshima Prefecture (JP)

(73) Assignee: Panasonic Corporation, Osaka (JP)

( * ) Notice: Subject to any disclaimer, the term of this patent is extended or adjusted under 35 U.S.C. 154(b) by 655 days.

(21) Appl. No.: 12/127,879

(22) Filed: May 28, 2008

(65) Prior Publication Data

US 2008/0238824 A1 Oct. 2, 2008

Related U.S. Application Data

(62) Division of application No. 11/104,652, filed on Apr. 13, 2005, now Pat. No. 7,408,531.

(30) Foreign Application Priority Data

Apr. 14, 2004 (JP) ..... 2004-119544

(51) Int. Cl.
*G09G 3/28* (2006.01)

(52) U.S. Cl. ..... 345/60; 345/66

(58) Field of Classification Search ..... 345/60–67
See application file for complete search history.

(56) References Cited

U.S. PATENT DOCUMENTS 6,608,609 B1 * 8/2003 Setoguchi et al. ..... 345/60
2003/0112206 A1 * 6/2003 Ando et al. ..... 345/60
2005/0116900 A1 * 6/2005 Kang et al. ..... 345/60
2006/0050023 A1 * 3/2006 Tachibana et al. ..... 345/63
2007/0103401 A1 * 5/2007 Myung ..... 345/67
2007/0176857 A1 * 8/2007 Sim et al. ..... 345/60
2008/0111802 A1 * 5/2008 Yoon et al. ..... 345/204
2008/0122745 A1 * 5/2008 Chung et al. ..... 345/60

FOREIGN PATENT DOCUMENTS

JP 2000-20021 A 1/2000
JP 2003015593 A 1/2003

(Continued)

OTHER PUBLICATIONS

Japanese Patent Office Action dated Apr. 8, 2010.

(Continued)

*Primary Examiner* — Nitin Patel
(74) *Attorney, Agent, or Firm* — Sughrue Mion, PLLC

(57) ABSTRACT

When a discharge start voltage takes a normal value under the normal temperature, priming discharge starts at a time t1. In this case, at a time t3 that is later than the time t1 by a predetermined time t, a sustain driver control signal Ssud2 is raised to put a sustain electrode into the floating state to stop the priming discharge. When the discharge start voltage takes a higher value than usual under the high temperature, the priming discharge starts at a time t2. In this case, at a time t4 that is later than the time t2 by the predetermined time t, the sustain driver control signal Ssud2 is lowered to put the sustain electrode into the floating state to stop the priming discharge. With such a configuration, provided is a plasma display device capable of implementing excellent and stable display quality while maintaining constant, even if a discharge start voltage varies, the charge state in display cells after a priming period, and a drive method for such a plasma display device.

5 Claims, 13 Drawing Sheets

FOREIGN PATENT DOCUMENTS

| | | | |
|---|---|---|---|
| JP | 2004-070359 | | 3/2004 |
| KR | 2003-0079491 | A | 10/2003 |
| KR | 10-2004-0013474 | A | 2/2004 |
| KR | 10-2004-0094147 | A | 11/2004 |

OTHER PUBLICATIONS

Korean Patent Office Action dated Jun. 18, 2010.

* cited by examiner

PLASMA DISPLAY DEVICE AND METHOD FOR DRIVING THE SAME

CROSS REFERENCE TO RELATED APPLICATIONS

This application is a divisional application of U.S. application Ser. No. 11/104,652 filed Apr. 13, 2005 now U.S. Pat. No. 7,408,531, which claims benefit of Japanese Application No. 2004-119544 filed Apr. 14, 2004, the entire disclosure of which is incorporated herein by reference.

BACKGROUND OF THE INVENTION

1. Field of the Invention

The present invention relates to alternating-current (AC) discharge plasma display devices and drive methods therefor.

2. Description of the Related Background Art

Plasma display devices including plasma display panels (in the below, referred also to as PDPs) serving as display panels generally have many advantages, e.g., thin-and-large-screen display with relative ease, wider viewing angle, and faster response speed. With such various advantages, the PDPS have recently become popular for use as flat displays of wall televisions, public display boards, and others. The PDPs are classified into two types of direct-current (DC) discharge PDPs and AC discharge PDPs according to their operation mode. The DC-type PDPs operate in response to direct-current discharge between electrodes, which are exposed to the discharge space filled with discharge gas. The AC-type PDPs operate under the conditions of AC discharge with electrodes not directly exposed to discharge gas with a dielectric layer therearound. With the DC-type PDPs, the discharge continues during voltage application, and with the AC-type PDPs, the discharge is sustained by reversing the voltage polarity. The AC-type PDPs are varying in the number of electrodes in a cell, i.e., two or three.

Described below is the structure and drive method of a conventional three-electrode AC-type plasma display device. FIG. 5 is a perspective view showing a display cell of the conventional AC-type plasma display device. FIG. 1 is a block diagram showing the conventional AC-type plasma display device. FIG. 2 is a circuit diagram showing a scan driver and a scan pulse driver of FIG. 1. FIG. 3 is a circuit diagram showing a sustain driver of FIG. 1. FIG. 4 is a circuit diagram showing a data driver of FIG. 1.

As shown in FIG. 1, the plasma display device is provided with a display panel 1, and a driving circuit therefor. The display panel 1 includes a plurality of display cells in a matrix.

By referring to FIG. 5, the display panel 1 is provided with two insulation substrates 101 and 102, both of which are made of glass. The insulation substrate 101 serves as a back substrate, and the insulation substrate 102 as a front substrate. The surface of the insulation substrate 102 facing the insulation substrate 101 carries transparent scanning electrodes 103 and transparent sustain electrodes 104, all of which are extending along the horizontal direction of the panel, i.e., lateral direction. In such a manner as to overlay on the scanning electrodes 103 and the sustain electrodes 104, trace electrodes 105 and 106 are provided. The trace electrodes 105 and 106 are made of metal, for example, and provided for the purpose of reducing the electrode resistance in value between the electrodes and an external drive. The scan electrodes 103 and the sustain electrodes 104 are covered by a dielectric layer 112, and the dielectric layer 112 is protected from discharge by a protection layer 114 made of magnesium oxide or others.

The surface of the insulation substrate 101 facing the insulation substrate 102 carries a data electrode 107. The data electrode 107 is placed orthogonal to the scan electrodes 103 and the sustain electrodes 104 viewed from the direction perpendicular to the surface of the insulation electrode 101, i.e., viewed from the top. The data electrode 107 thus extends along the perpendicular direction of the panel, i.e., longitudinal direction. A partition wall 109 is also provided to partition the display cell in the horizontal direction. A dielectric layer 113 covers the data electrode 107, and on the surface of the dielectric layer 113 and the side surfaces of the partition wall 109, a fluorescent layer 111 is formed. The fluorescent layer 111 is the one converting ultraviolet light into visible light 110 through discharge of discharge gas. By the partition wall 109, a discharge gas space 108 is reserved between the insulation substrates 101 and 102. The discharge gas space 108 is filled with discharge gas of helium, neon, or xenon, or gas mixture thereof.

By referring back to FIG. 1, in the display panel 1, n (where n is a natural number) scan electrodes $\mathbf{3}_1$ to $\mathbf{3}_n$ (103) and n sustain electrodes $\mathbf{4}_1$ to $\mathbf{4}_n$ (104) are alternately provided at established intervals. These scan electrodes $\mathbf{3}_1$ to $\mathbf{3}_n$ and sustain electrodes $\mathbf{4}_1$ to $\mathbf{4}_n$ are all extending in the line direction (horizontal direction). The display panel 1 also includes m (where m is a natural number) data electrodes $\mathbf{10}_1$ to $\mathbf{10}_m$ (107) extending in the column direction (vertical direction). These data electrodes $\mathbf{10}_1$ to $\mathbf{10}_m$ are so placed as to be orthogonal to the scan electrodes $\mathbf{3}_1$ to $\mathbf{3}_n$ and the sustain electrodes $\mathbf{4}_1$ to $\mathbf{4}_n$ when viewed from the top. Display cells are also provided in a matrix, each at a point most proximal to both the scan electrode and the data electrode, or at a point most proximal to both the sustain electrode and the data electrode. This means that the display panel 1 carries (n H m) display cells.

The plasma display device is provided with a drive power source 21, a controller 22, a scan driver 23, a scan pulse driver 24, a sustain driver 25, and a data driver 26, all serve as drive circuits of the display panel 1.

The drive power source 21 generates, for example, a logic voltage Vdd of 5V, a data voltage Vd of about 70V, and a sustain voltage Vs of about 170V. The drive power source 21 also generates, based on the sustain voltage Vs, a priming voltage Vp of about 400V, a scan base voltage VbW of about 100V, and a bias voltage Vsw of about 180V. The logic voltage Vdd goes to the controller 22, the data voltage Vd goes to the data driver 26, the sustain voltage Vs goes to both the scan driver 23 and the sustain driver 25, the priming voltage Vp and the scan base voltage Vbw go to the scan driver 23, and the bias voltage Vsw goes to the sustain driver 25.

The controller 22 is a circuit for generating various control signals based on a video signal Sv coming from the outside. The control signals include scan driver control signals Sscd1 to Sscd6, scan pulse driver control signals Sspd11 to Sspd1*n* and Sspd21 to Sspd2*n*, sustain driver control signals Ssud1 to Ssud3, and data driver control signals Sdd11 to Sdd1*m* and Sdd21 to Sdd2*m*. The scan driver control signals Sscd1 to Sscd6 all go to the scan driver 23, the scan pulse driver control signals Sspd11 to Sspd1*n* and Sspd21 to Sspd2*n* all go to the scan pulse driver 24, the sustain driver control signals Ssud1 to Ssud3 all go to the sustain driver 25, and the data driver control signals Sdd11 to Sdd1*m* and Sdd21 to Sdd2*m* all go to the data driver 26.

Referring to FIG. 2, the scan driver 23 is exemplarily configured by six switches $\mathbf{23}_1$ to $\mathbf{23}_6$. The switch $\mathbf{23}_1$ receives the priming voltage Vp at one end, and the other end thereof is connected to a positive line 27. The switch $\mathbf{23}_2$ receives the sustain voltage Vs at one end, and the other end thereof is connected also to the positive line 27. The switch $\mathbf{23}_3$ is grounded at one end, and the other end thereof is connected to a negative line 28. The switch $\mathbf{23}_4$ receives the scan base voltage Vbw at one end, and the other end thereof is connected also to the negative line 28. The switch $\mathbf{23}_5$ is grounded at one end, and the other end thereof is connected to the positive line 27. The switch $\mathbf{23}_6$ is grounded at one end, and the other end thereof is connected to the negative line 28. These switches $\mathbf{23}_1$ to $\mathbf{23}_6$ are respectively turned ON or OFF based on their corresponding scan driver control signals Sscd1 to Sscd6. The voltage of a predetermined waveform is then forwarded to the scan pulse driver 24 through the positive and negative lines 27 and 28. In the scan driver 23, a resistance element (not shown) such as a field-effect transistor is connected to between the switch $\mathbf{23}_1$ and a node (not shown) receiving the priming voltage Vp, and the switch $\mathbf{23}_2$ and a node (not shown) receiving the sustain voltage Vs. Such a resistance element successively changes the voltage for application to the switches $\mathbf{23}_1$ and $\mathbf{23}_2$ through change of the resistance value between source and drain as a result of application of control voltage to a gate.

Still referring to FIG. 2, the scan pulse driver 24 is exemplarily configured by n switches $\mathbf{24}_{11}$ to $\mathbf{24}_{1n}$, n switches $\mathbf{24}_{21}$ to $\mathbf{24}_{2n}$, n diodes $\mathbf{24}_{31}$ to $\mathbf{24}_{3n}$, and n diodes $\mathbf{24}_{41}$ to $\mathbf{24}_{4n}$. The diodes $\mathbf{24}_{31}$ to $\mathbf{24}_{3n}$ are connected in parallel to their corresponding switches $\mathbf{24}_{11}$ to $\mathbf{24}_{1n}$ at both ends, and the diodes $\mathbf{24}_{41}$ to $\mathbf{24}_{4n}$ are connected in parallel to their corresponding switches $\mathbf{24}_{21}$ to $\mathbf{24}_{2n}$ at both ends. The switches $\mathbf{24}_{1a}$ (where a is a natural number equal to or smaller than n) is connected serially to the switch $\mathbf{24}_{2a}$. The switches $\mathbf{24}_{11}$ to $\mathbf{24}_{1n}$ are each connected to the negative line 28 at one end, and the switches $\mathbf{24}_{21}$ to $\mathbf{24}_{2n}$ are each connected to the positive line 27 at one end. The connection point between the switches $\mathbf{24}_{1a}$ and $\mathbf{24}_{2a}$ is connected to the scan electrode $\mathbf{3}_a$ that is placed at the ath line, counting from the upper side of the display panel 1. The switches $\mathbf{24}_{11}$ to $\mathbf{24}_{1n}$, and $\mathbf{24}_{21}$ to $\mathbf{24}_{2n}$ are each turned ON or OFF based on the scan pulse driver control signals Sspd11 to Sspd1*n* and Sspd21 to Sspd2*n*. The scan electrodes $\mathbf{3}_1$ to $\mathbf{3}_n$ then sequentially receive the voltage Psc1 to Pscn of a predetermined waveform.

By referring to FIG. 3, the sustain driver 25 is exemplarily configured by three switches $\mathbf{25}_1$ to $\mathbf{25}_3$. The switch $\mathbf{25}_1$ receives the sustain voltage Vs at one end, and the other end thereof is connected to all the sustain electrodes $\mathbf{4}_1$ to $\mathbf{4}_n$. The switch 252 is grounded at one end, and the other end thereof is connected to all the sustain electrodes $\mathbf{4}_1$ to $\mathbf{4}_n$. The switch 253 receives the bias voltage Vsw at one end, and the other end thereof is connected to all the sustain electrodes $\mathbf{4}_1$ to $\mathbf{4}_n$. The switches $\mathbf{25}_1$ to $\mathbf{25}_3$ are each turned ON or OFF based on their corresponding sustain driver control signals Ssud1 to Ssud3. The sustain electrodes $\mathbf{4}_1$ to $\mathbf{4}_n$ then simultaneously receive a voltage Psu of a predetermined waveform.

By referring to FIG. 4, the data driver 26 is exemplarily configured by m switches $\mathbf{26}_{11}$ to $\mathbf{26}_{1m}$, m switches $\mathbf{26}_{21}$ to $\mathbf{26}_{2m}$, m diodes $\mathbf{26}_{31}$ to $\mathbf{26}_{3m}$, and *m* diodes $\mathbf{26}_{41}$ to $\mathbf{26}_{4m}$. The diodes $\mathbf{26}_{31}$ to $\mathbf{26}_{3m}$ are connected in parallel to their corresponding switches $\mathbf{26}_{11}$ to $\mathbf{26}_{1m}$ at both ends, and the diodes $\mathbf{26}_{41}$ to $\mathbf{26}_{4m}$ are connected in parallel to their corresponding switches $\mathbf{26}_{21}$ to $\mathbf{26}_{2m}$ at both ends. The switches $\mathbf{26}_{1b}$ (where b is a natural number equal to or smaller than m) is connected serially to the switch $\mathbf{26}_{2b}$. The switches $\mathbf{26}_{11}$ to $\mathbf{26}_{1m}$ are each grounded at one end, and the switches $\mathbf{26}_{21}$ to $\mathbf{26}_{2m}$ each receive the data voltage Vd at one end. The connection point between the switches $\mathbf{26}_{1b}$ to $\mathbf{26}_{2b}$ is connected to the data electrode $\mathbf{10}_b$ at the bth line, counting from the left side of the display panel 1. The switches $\mathbf{26}_{11}$ to $\mathbf{26}_{1m}$, and $\mathbf{26}_{21}$ to $\mathbf{26}_{2m}$ are each turned ON or OFF based on the data driver control signals Sdd1*m* to Sdd21 and Sdd21 to Sdd2*m*. The data electrodes $\mathbf{10}_1$ to $\mathbf{10}_m$ then sequentially receive the voltages Pd1 to Pdm of a predetermined waveform.

Described next is the write-select drive operation of the conventional plasma display device structured as above. FIG. 6 is a timing chart showing the write-select drive operation of the conventional plasma display device. In the drive method of the conventional plasma display device, a field is configured by a plurality of subfields (hereinafter, referred also to as SFs), and each subfield has four periods of priming period Tp, address period Ta, sustain period Ts, and charge removal period Te, those of which are set in sequence. In the priming period Tp, the display cells are all illuminated so as to activate, equalize, and initiate their charge state. In the address period Ta, the display cells are all made to cause write discharge to generate wall charge before generating sustain discharge in the subsequent sustain period Ts. In the sustain period Ts, the sustain discharge is generated in the display cells formed with the wall charge in the preceding address period Ta. In the charge removal period Te, the wall charge is removed from the display cells illuminated in the sustain period Ts.

Described next in detail is the operation in each of those periods. In the below, as to the scan electrodes and the sustain electrodes, their reference potential is the sustain voltage Vs. The potential higher than the sustain voltage Vs is referred to as positive potential, and as negative potential for the lower potential. The reference potential of the data electrodes is a ground voltage GND, and the potential higher than that is referred to as positive potential, and as negative potential for the lower potential.

In the priming period Tp, the controller 22 first starts generating control signals, i.e., the scan driver control signals Sscd1 to Sscd6, the sustain driver control signals Ssud1 to Ssud3, and the scan pulse driver control signals Sspd11 to Sspd1*n* and Sspd21 to Sspd2*n*. The control signals also include the data driver control signals Sdd11 to Sdd1*m* in the level based on the video signal Sv coming from the outside, and the data driver control signals Sdd21 to Sdd2*m* in the low level. Thus generated control signals are forwarded to their corresponding drivers.

As a result, in the priming period Tp, the high-level scan driver control signal Sscd1 turns ON the switch $\mathbf{23}_1$, and the high-level sustain driver control signal Ssud2 turns ON the switch $\mathbf{25}_2$. The scan pulse driver control signal Sspd11 to Sspd1*n* are all lowered in level so that the switches $\mathbf{24}_{11}$ to $\mathbf{24}_{1n}$ are all turned OFF, and the scan pulse driver control signals Sspd21 to Sspd2*n* are all raised in level so that the switches $\mathbf{24}_{21}$ to $\mathbf{24}_{2n}$ are all turned ON. Accordingly, as shown in FIG. 6, the scan electrodes $\mathbf{3}_1$ to $\mathbf{3}_n$ all receive a positive priming pulse Pprp, and the sustain electrodes $\mathbf{4}_1$ to $\mathbf{4}_n$ all receive a negative priming pulse Pprn. In the display cells, this causes priming discharge in the discharge gas space 108 in the vicinity of an electrode-to-electrode gap, i.e., between the scan electrodes 103 ($\mathbf{3}_1$ to $\mathbf{3}_n$) and the sustain electrodes 104 ($\mathbf{4}_1$ to $\mathbf{4}_n$). At this time, by successively changing the resistance value of the resistance element that is connected between the switch $\mathbf{23}_1$ and the priming voltage Vp, the priming pulse Pprp can be of a saw tooth waveform with which the potential continuously increases from the sustain voltage Vs to the priming voltage Vp.

In this manner, active particles are generated in the discharge space 108 for helping generate write discharge in the display cells. Moreover, the scan electrodes $\mathbf{3}_1$ to $\mathbf{3}_n$ are each attached with the negative wall charge, the sustain electrodes $\mathbf{4}_1$ to $\mathbf{4}_n$ are each attached with the positive wall charge, and the data electrodes $\mathbf{10}_1$ to $\mathbf{10}_m$ are each attached with the positive wall charge thereon.

Thereafter, responding to the sustain driver control signal Ssud2 lowered in level, the switch $\mathbf{25}_2$ is responsively turned OFF, and the sustain electrodes 104 ($\mathbf{4}_1$ to $\mathbf{4}_n$) are put into the floating state. As a result, the potential of the sustain electrodes 104 is successively increased due to the potential of the scan electrodes 103, thereby stopping the priming discharge. As such, stopping the priming discharge with the sustain electrodes 104 put into the floating state can prevent the priming discharge from being excessive, favorably reducing the black level, i.e., the brightness of the lowest tone (number 0). Accordingly, to reduce such a black level, preferably, the sooner the better to put the sustain electrodes 104 into the floating state as long as the priming discharge can sufficiently occur.

The sustain driver control signal Ssud1 is then raised in level, and the switch $\mathbf{25}_1$ is responsively turned ON. The scan driver control signal Sscd2 is then lowered in level, and the switch $\mathbf{23}_2$ is turned OFF. The scan driver control signal Sscd3 is then raised in level, and the switch $\mathbf{23}_3$ is turned ON. As a result, after the sustain electrodes $\mathbf{4}_1$ to $\mathbf{4}_n$ are all maintained at the potential of 170V sustain voltage Vs, the scan electrodes $\mathbf{3}_1$ to $\mathbf{3}_n$ each receive a priming removal pulse Ppre. Such pulse application resultantly causes weak-level discharge in every display cell, and this reduces the wall charge on the electrodes, i.e., the negative wall charge on the scan electrodes $\mathbf{3}_1$ to $\mathbf{3}_n$, the positive wall charge on the sustain electrodes $\mathbf{4}_1$ to $\mathbf{4}_n$, and the positive wall charge on the data electrodes $\mathbf{10}_1$ to $\mathbf{10}_m$.

In the early address period Ta, the switch $\mathbf{25}_3$ is being ON due to the high-level sustain driver control signal Ssud3, and the switches $\mathbf{23}_4$ and $\mathbf{23}_5$ are both being ON due to the high-level scan driver control signals Sscd4 and Sscd5, both are those provided in the later priming period Tp. Here, the switches $\mathbf{24}_{11}$ to $\mathbf{24}_{1n}$ are being ON, and the switches $\mathbf{24}_{21}$ to $\mathbf{24}_{2n}$ are being OFF due to the high-level scan pulse driver control signals Sspd11 to Sspd1*n*, and the low-level scan pulse driver control signals Sspd21 to Sspd2*n*. Therefore, the sustain electrodes $\mathbf{4}_1$ to $\mathbf{4}_n$ each receive a positive-going (bias voltage VsW) bias pulse Pbp, and the potential of the pulses Psc1 to Spcn to be applied to the scan electrodes $\mathbf{3}_1$ to $\mathbf{3}_n$ is temporarily maintained at the scan base voltage Vbw.

Under such a state, the scan pulse driver control signals Sspd11 to Sspd1*n* are sequentially lowered in level, and correspondingly thereto, the scan pulse driver control signals Sspd21 to Sspd2*n* are sequentially raised in level. In response to such level change, the switches $\mathbf{24}_{11}$ to $\mathbf{24}_{1n}$ are consecutively turned OFF, and the switches $\mathbf{24}_{21}$ to $\mathbf{24}_{2n}$ are consecutively turned ON. In synchronization therewith, although not shown, the data driver control signals Sdd11 to Sdd1*m* are raised in level based on the video signal Sv, and correspondingly thereto, the data driver control signals Sdd21 to Sdd2*m* are lowered in level. In response, the switches $\mathbf{26}_{11}$ to $\mathbf{26}_{1m}$ are all turned ON based on the video signal Sv, and the switches $\mathbf{26}_{21}$ to $\mathbf{26}_{2m}$ are all turned OFF. When writing is performed in the display cell locating at the ath line and the bth column, the scan electrode $\mathbf{3}_a$ at the ath line receives the negative scan pulse Pwsn, and the data electrode $\mathbf{10}_b$ at the bth column receives the positive data pulse Pdb. This resultantly causes opposing discharge in the display cell at the ath line and the bth column. This opposing discharge serves as a trigger, and surface discharge occurs as writing discharge between the scan electrodes and the sustain electrodes, whereby the electrodes are attached with the wall charge. The display cells having no writing discharge caused therein remain in the less-wall-discharge state after the electric charge is removed in the priming period Ta.

In the next sustain period Ts, the scan driver control signals Sscd2 and Sscd6 alternately rise and fall repeatedly for the number of times predetermined for the subfield. As a result, the switches $\mathbf{23}_2$ and $\mathbf{23}_6$ are alternately turned ON and OFF repeatedly. In synchronization therewith, the sustain driver control signals Ssud1 and Ssud2 alternately rise and fall repeatedly for the number of times predetermined for the subfield, and resultantly the switches $\mathbf{25}_1$ and $\mathbf{25}_2$ are alternately turned ON and OFF repeatedly. Accordingly, the scan electrode $\mathbf{3}_1$ to $\mathbf{3}_n$ each receive the negative sustain pulse Psun1 for the number of times predetermined for the subfield, and in synchronization with the sustain pulse Psun1, the sustain electrodes $\mathbf{4}_1$ to $\mathbf{4}_n$ receive the negative sustain pulse Psun2 for the number of times predetermined for the subfield. At this time, the display cells having no writing performed therein in the address period Ta have considerably less amount of wall charge, and thus no sustain discharge occurs even if the display cells receive the sustain pulse. On the other hand, in the display cells having writing discharge caused therein in the address period Ta, the scan electrodes are attached with the positive charge, and the sustain electrodes are attached with the negative charge. The sustain pulse and the wall charge voltage are thus superposed on each other, and the voltage between the electrodes exceeds the discharge start voltage so that discharge occurs.

In the next charge removal period Te, the scan driver control signal Sscd3 rises, and thus the switch $\mathbf{23}_3$ is accordingly turned on. As a result, the scan electrodes $\mathbf{3}_1$ to $\mathbf{3}_n$ each receive a negative charge removal pulse Peen. Such pulse application resultantly causes weak-level discharge in every display cell, and this reduces the wall charge on the scan electrodes and sustain electrodes in the display cells that have been illuminated in the sustain period Ts, whereby the display cells can be all made uniform in their charge state.

With such a conventional technology, however, there are the following problems. The discharge start voltage at which discharge starts in the display cells is not generally constant but varies. With Paschen's Law, the discharge start voltage is dependent on the product of the electrode-to-electrode distance and the display cell pressure. Under the requirements for the plasma display devices to operate, the discharge start voltage will be higher with the larger product. If the PDP is increased in temperature, for example, the pressure increase is observed not only for the discharge gas itself but also in the discharge cells. This is due to gas escape, which is absorbed in the partition walls in the display cells. This resultantly increases the discharge start voltage. If no discharge occurs for a long time, charged particles in the discharge cells are reduced in number with time. This is the reason why the discharge start voltage is higher at start-up of the plasma display devices compared with during their steady-state operation.

FIG. 7 is a timing chart showing in detail the priming period Tp of FIG. 6. FIG. 7 shows a part of the address period Ta subsequent to the priming period Tp, and the charge removal period Te for the preceding subfield. As shown in FIG. 7, when the discharge start voltage takes a normal value, e.g., when the PDP is at the normal temperature, the priming discharge starts at a time t1 at which the potential difference (hereinafter, referred also to as surface voltage) between the scan electrodes and the sustain electrodes exceeds the discharge start voltage. At a time t3 at which the sustain electrodes are put into the floating state, the priming discharge stops. On the other hand, when the discharge start voltage takes a higher value than usual, i.e., when the PDP is at the high temperature, the surface voltage exceeds the discharge start voltage at a time t2 later than the time t1 so that the priming discharge starts. The priming discharge started as such stops at the time t3. Therefore, when the PDP is high in temperature, the priming discharge does not continue that long compared with when the PDP is at the normal temperature, and thus the priming discharge is not enough. If the discharge start voltage is considerably high, the surface voltage may not reach the discharge start voltage even at the time t3, and thus no priming discharge may occur.

In consideration thereof, to cause the priming discharge without fail even when the discharge start voltage is high, there is no choice but to set the priming voltage Vp higher. Thus set priming voltage Vp is unnecessarily high for the normal conditions with the low discharge start voltage, resultantly causing the priming discharge to be excessive. The resulting excessive priming discharge raises the black level, thereby lowering the image contrast. If the priming voltage Vp is set at its optimum value for the normal conditions with the low discharge start voltage, as described above, no priming discharge occurs when the discharge start voltage is high. Even if the priming discharge occurs, the resulting level is not enough. This results in writing failure for some display cells with no writing discharge occurred. In the display cells observed with such writing failure, no sustain discharge occurs, and thus images suffer from inconsistency, unfavorably degrading in image quality.

For betterment, Patent Document 1 (JP-A-2000-20021) describes the technology of increasing the priming voltage at start-up of plasma display devices compared with during their steady-state operation with rectangular priming pulses. In Patent Document 1, there is a description telling that the priming discharge occurs without fail even at the PDP start-up.

In the technology of Patent Document 1, however, the rectangular priming pulses arises a problem. That is, the rectangular pulses cause instability during discharge, and the resulting discharge will be unnecessarily too bright. In this sense, the rectangular priming pulses are not considered practical.

In view thereof, there is a possibility of increasing the priming voltage only at the PDP start-up as described in Patent Document 1 with the saw tooth priming pulses as shown in FIGS. 13 and 14. With this method, the priming discharge can be indeed started when the discharge start voltage is high, but the start time therefor varies. The concern here is that the time t3 at which discharge stops is substantially constant irrespective of the discharge start voltage. Therefore, a change of the discharge start voltage leads to a length change of the period for the priming discharge, causing the priming discharge to be nonuniform. As a result, the display cells through with the priming period will not be uniform in their charge state depending on the operation requirements, resulting in varying display quality.

SUMMARY OF THE INVENTION

The present invention is proposed in consideration of such problems, and an object thereof is to provide a plasma display device capable of implementing excellent and stable display quality while maintaining constant, even if a discharge start voltage changes, the charge state in display cells through with a priming period, and a drive method for such a plasma display device.

A first aspect of the present invention is directed to a plasma display device that includes: a display panel with a plurality of display cells that is provided with scan electrodes, sustain electrodes, and data electrodes; and a drive circuit for applying a voltage to the scan electrodes, the sustain electrodes, and the data electrodes based on display data. In the plasma display device, a field is divided into one or more subfields for display, and to at least one of the subfields, a priming period is provided to cause priming discharge to activate the charge state. The drive circuit estimates a discharge start voltage for the display panel, and changes a waveform of a voltage applied to at least one electrode of the scan electrode, the sustain electrode, and the data electrode between a first case with a first estimated value of the discharge start voltage and a second case with a second estimated value which is smaller than the first estimated value. After the priming discharge, the drive circuit also sets smaller a charge amount difference in the display cells between the first case and the second case than a difference in a case where no voltage waveform is changed.

According to the first aspect of the present invention, after the priming discharge, the drive circuit controls the voltage to be applied to the scan electrodes and sustain electrodes in such a manner as to reduce the variation of a charge amount in the display cells resulted from the varying discharge start voltage. With such control application, the display cells can be uniform in the charge state after the priming discharge no matter if the discharge start voltage varies.

A second aspect of the present invention is directed to a plasma display device that includes: a display panel that is provided with scan electrodes, sustain electrodes, and data electrodes; and a drive circuit for applying a voltage to the scan electrodes, the sustain electrodes, and the data electrodes based on display data. In the plasma display device, a field is divided into one or more subfields for display, and to at least one of the subfields, a priming period is provided to cause priming discharge to activate a charge state. The drive circuit estimates a discharge start voltage for the display panel, and changes a waveform of a voltage applied to at least one electrode of the scan electrode, the sustain electrode, and the data electrode between a first case with a first estimated value of the discharge start voltage and a second case with a second estimated value which is smaller than the first estimated value. The drive circuit also sets smaller a difference of priming discharge duration between the first case and the second case than a difference in a case where no voltage waveform is changed.

According to the second aspect of the present invention, after the priming discharge, the drive circuit controls the voltage to be applied to the scan electrodes and sustain electrodes in such a manner as to reduce the variation of the priming discharge duration resulted from the varying discharge start voltage. With such control application, no matter if the discharge start voltage varies, the priming discharge can be controlled not to vary in intensity that much, and the display cells can be uniform in the charge state after the priming discharge.

The drive circuit may include: a temperature sensor for measuring the temperature of the display panel; a discharge start voltage estimation circuit storing correlation data between the temperature of the display panel and the discharge start voltage for estimating the discharge start voltage based on a measurement result derived by the temperature sensor; and a controller for controlling a voltage to be applied to the scan electrodes and the sustain electrodes based on the measurement result. With such a configuration, even if the discharge start voltage varies due to the temperature change occurring to the display panel, the priming discharge is no more sensitive thereto.

As another alternative configuration, the drive circuit may include: a timer for outputting a first signal for a predetermined time after start-up, and outputting a second signal after the predetermined time is passed; and a controller for controlling a voltage to be applied to the scan electrodes and the sustain electrodes based on the output signal from the timer. Also with such a configuration, even if the discharge start voltage varies at start-up of the plasma display device, the priming discharge is no more sensitive thereto.

A third aspect of the present invention is directed to a plasma display device that includes: a display panel that is provided with scan electrodes and sustain electrodes; and a drive circuit for applying a voltage to the scan electrodes and the sustain electrodes. In the plasma display device, a field is divided into one or more subfields for display, and to at least one of the subfields, a priming period is provided to cause priming discharge to activate a charge state. The drive circuit provides the priming period with a first period for successively increasing a potential difference between the scan electrodes and the sustain electrodes, and a second period for putting either the scan electrodes or the sustain electrodes into the floating state. The drive circuit estimates a discharge start voltage between the scan electrodes and the sustain electrodes, and in a first case where the resulting estimated value of the discharge start voltage is a first value, delays the transition timing from the first period to the second period compared with a second case where the estimated value is a second value that is smaller than the first value.

According to the third aspect of the present invention, even if the start time varies for the priming discharge due to the varying discharge start voltage, the display cells can be controlled not to vary that much in the charge state after the priming discharge.

A fourth aspect of the present invention is directed to a plasma display device that includes: a display panel that is provided with scan electrodes and sustain electrodes; and a drive circuit for applying a voltage to the scan electrodes and the sustain electrodes. In the plasma display device, a field is divided into one or more subfields for display, and to at least one of the subfields, a priming period is provided to cause priming discharge to activate a charge state. The drive circuit provides the priming period with a first period for successively increasing a potential difference between the scan electrodes and the sustain electrodes, and a second period for decreasing the potential difference. The drive circuit estimates a discharge start voltage between the scan electrodes and the sustain electrodes, and in a first case where the resulting estimated value of the discharge start voltage is a first value, applies a voltage to the scan electrodes and the sustain electrodes in such a manner that an increase rate is higher for the potential difference in the first period than for that in a second case where the resulting estimated value is a second value that is smaller than the first value.

According to the fourth aspect of the present invention, even if the discharge start voltage varies, the start time and duration of the priming discharge can be both controlled not to vary that much. This accordingly controls the charge amount in the display cells not to vary that much after the priming discharge.

A fifth aspect of the present invention is directed to a plasma display device that includes: a display panel that is provided with scan electrodes and sustain electrodes; and a drive circuit for applying a voltage to the scan electrodes and the sustain electrodes. In the plasma display device, a field is divided into one or more subfields for display, and to at least one of the subfields, a priming period is provided to cause priming discharge to activate a charge state. The drive circuit provides the priming period with a first period for successively increasing a potential difference between the scan electrodes and the sustain electrodes, and a second period for decreasing the potential difference. The drive circuit estimates a discharge start voltage between the scan electrodes and the sustain electrodes, and in a first case where the resulting estimated value of the discharge start voltage is a first value, delays the transition timing from the first period to the second period compared with a second case where the estimated value is a second value that is smaller than the first value.

According to the fifth aspect of the present invention, even if the start time varies for the priming discharge due to the varying discharge start voltage, the display cells can be controlled not to vary that much in the charge state after the priming discharge.

A sixth aspect of the present invention is directed to a drive method for a plasma display device, in which a field is divided into one or more subfields for display, and to at least one of the subfields, a priming period is provided to cause priming discharge to activate a charge state. The drive method comprises the steps of: estimating a discharge start voltage for a display panel; changing a waveform of a voltage applied to at least one electrode of the scan electrode, the sustain electrode, and the data electrode between a first case with a first estimated value of the discharge start voltage and a second case with a second estimated value which is smaller than the first estimated value; and after the priming discharge, setting smaller a charge amount difference in the display cells between the first case and the second case than a difference in a case where no voltage waveform is changed.

According to the sixth aspect of the present invention, the voltage to be applied to the scan electrodes and sustain electrodes is so controlled as to make uniform the discharge amount in the display cells after the priming discharge. With such control application, the display cells can be uniform in the charge state after the priming discharge no matter if the discharge start voltage varies.

In an alternative manner, the priming period may include a first period for successively increasing a potential difference between the scan electrodes and the sustain electrodes, and a second period for putting either the scan electrodes or the sustain electrodes into the floating state. Based on the estimation result derived for the discharge start voltage, the start time is calculated for the priming discharge in the first period. When the calculated start time is a first time, the transition timing from the first period to the second period may be delayed compared with in a case where the start time is a second time that is later than the first time. In this manner, the priming discharge stops at the transition from the first period to the second period, and thus even if the start time of the priming discharge varies due to the varying discharge start voltage, the display cells can be uniform in the charge state after the priming discharge.

In another alternative manner, the priming period may include a first period for successively increasing the potential difference between the scan electrodes and the sustain electrodes, and a second period for decreasing the potential difference. In the first case, an increase rate may be set higher for the potential difference in the first period than for that in the second case. In this manner, the start time of the priming discharge is controlled not to vary that much no matter if the discharge start voltage varies.

In still another alternative manner, the priming period may include a first period for successively increasing the potential difference between the scan electrodes and the sustain electrodes, and a second period for decreasing the potential difference. Based on the estimation result derived for the discharge start voltage, the start time is calculated for the priming discharge in the first period. When the calculated start time is a first time, the transition timing from the first period to the second period may be delayed compared with in a case where the start time is a second time that is earlier than the first time. In this manner, the priming discharge stops at the transition from the first period to the second period, and thus even if the start time of the priming discharge varies due to the varying discharge start voltage, the display cells can be prevented from varying that much in the charge state after the priming discharge.

According to the sixth aspect of the present invention, in the plasma display device, after the priming discharge, the variation of the charge amount in the display cells resulted from the varying discharge start voltage is controlled. Accordingly, even if the discharge start voltage varies, the discharge cells can be uniform in charge state even after the priming period, thereby successfully implementing the excellent and stable display quality.

DETAILED DESCRIPTION OF THE INVENTION

Figure 8:
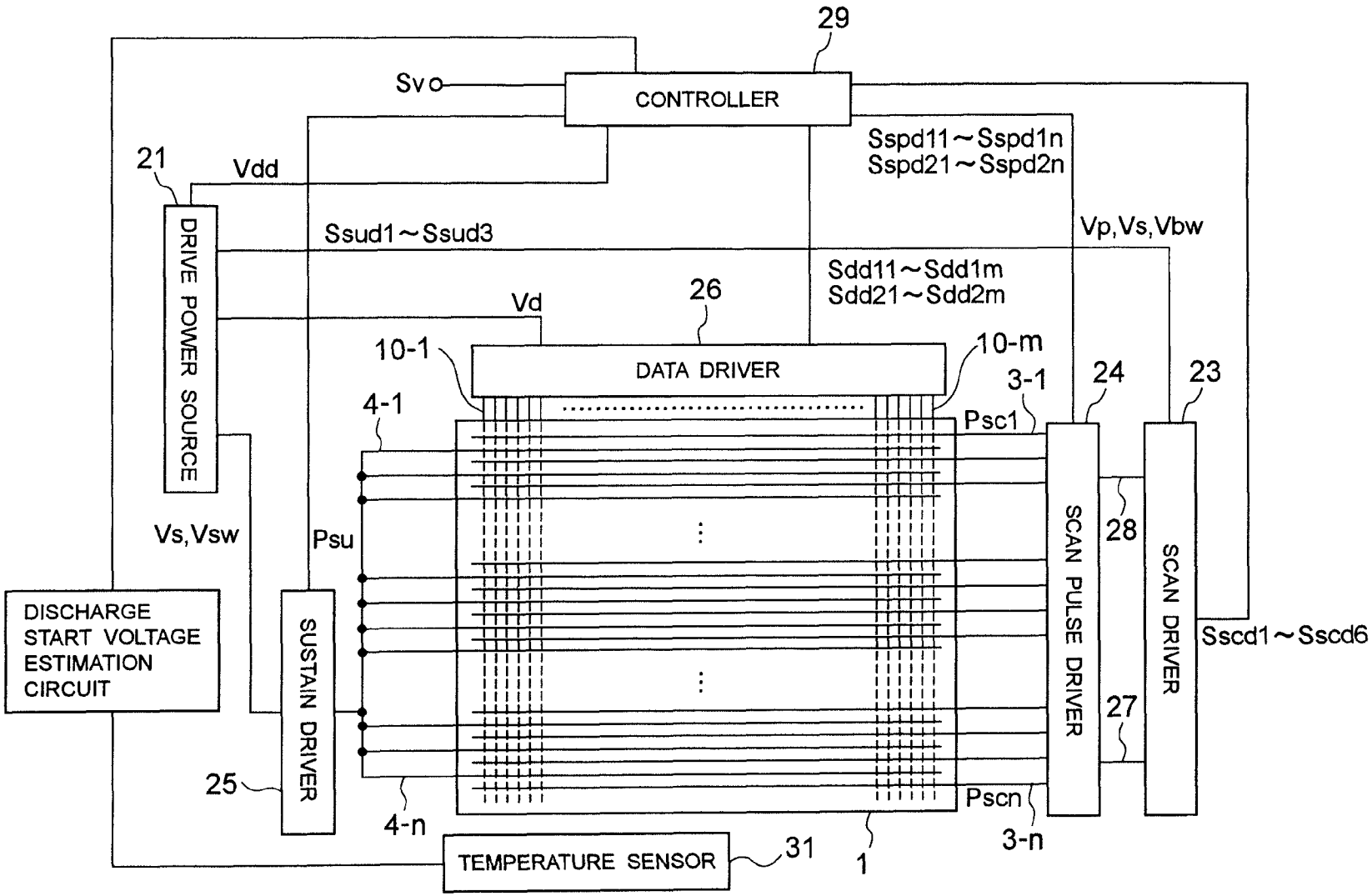
FIG. 8 is a block diagram showing a plasma display device of the present invention.
Figure 9:
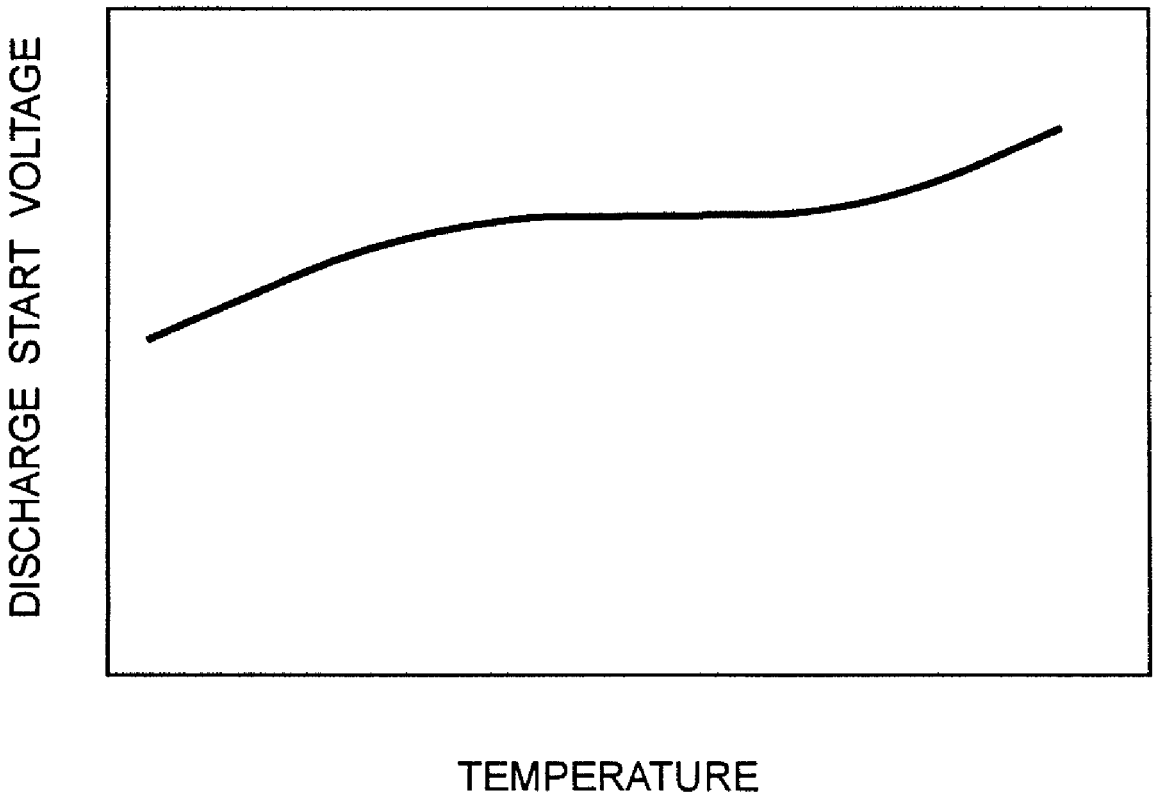
FIG. 9 is a graph diagram showing the temperature-and-discharge-start-voltage correlation data stored in a discharge start voltage estimation circuit in the device of FIG. 8.

In the below, embodiments of the present invention are specifically described by referring to the accompanying drawings. Described first is a first embodiment of the present invention. FIG. 8 is a block diagram showing a plasma display device of this first embodiment, and FIG. 9 is a graph diagram showing the temperature-and-discharge-start-voltage correlation data stored in a discharge start voltage estimation circuit of FIG. 8. In the graph diagram, the lateral axis represents the temperature of a display panel, and the vertical axis represents a discharge start voltage.

Figure 5:
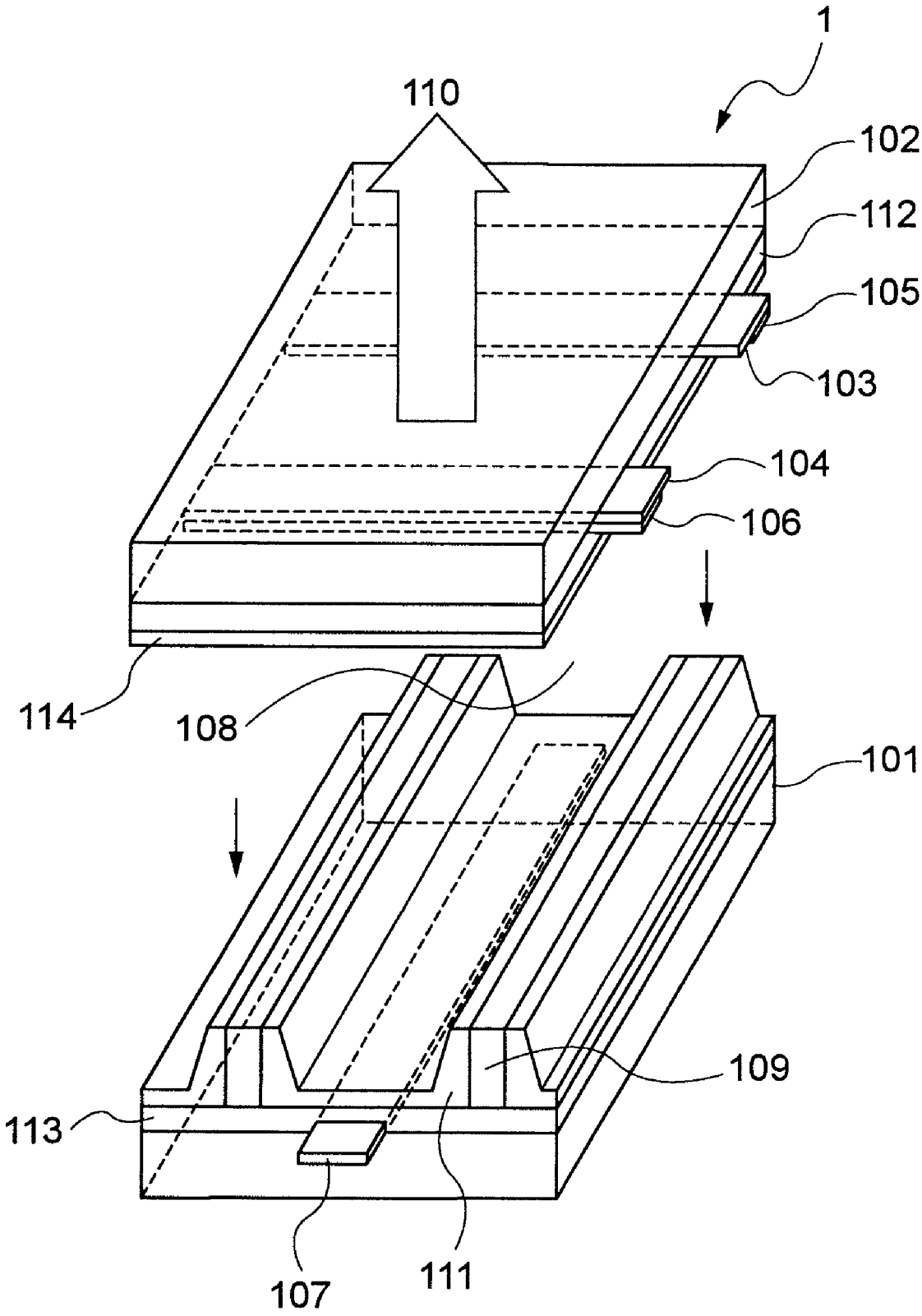
FIG. 5 is a perspective view of a display cell in the conventional AC-type plasma display device.
Figure 6:
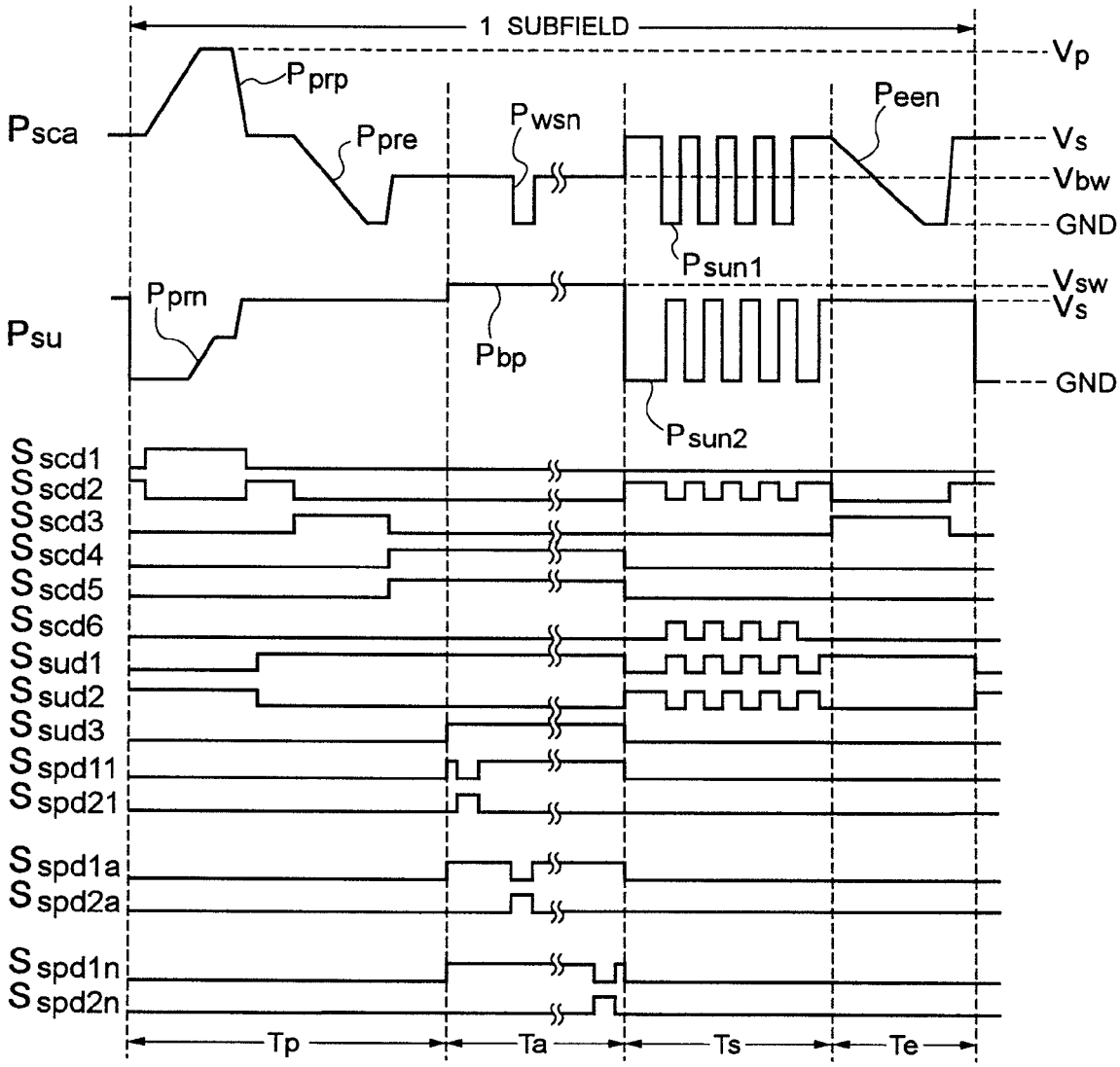
FIG. 6 is a timing chart showing the write-select drive operation of the conventional AC-type plasma display device.
Figure 7:
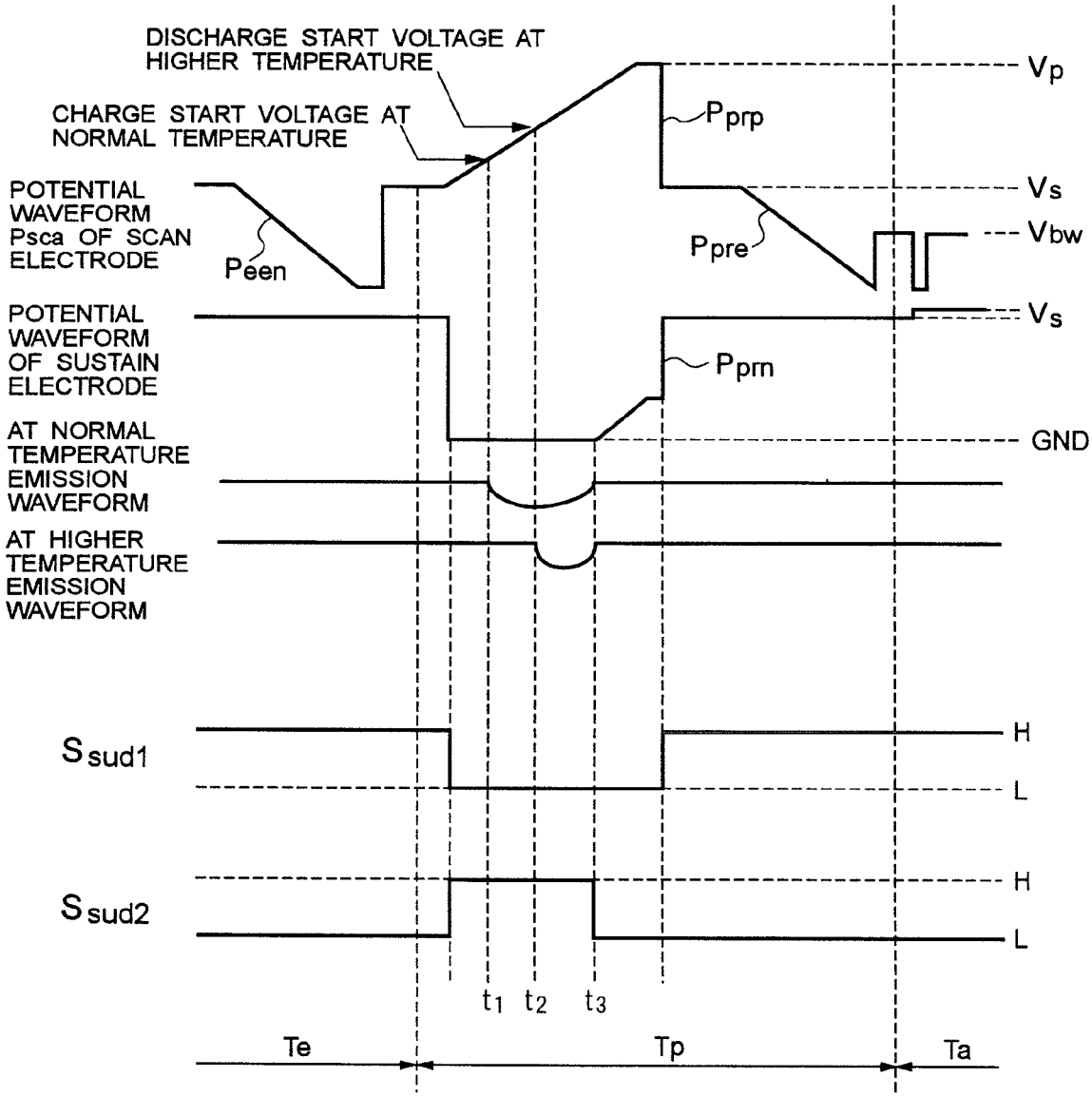
FIG. 7 is a timing chart showing in detail a priming period Tp of FIG. 13.

As shown in FIG. 8, the plasma display device of this first embodiment is provided with a temperature sensor 31 for measuring the temperature of the display panel 1. The temperature sensor 31 is singly or plurally provided at such positions that the insulation substrates 101 and 102 (refer to FIG. 5) of the display panel 1 can be measured for their temperature. The temperature sensor 31 is exemplarily a sensor provided with a thermocouple at the position where the heat comes from the display panel 1. For example, the temperature sensor 31 is singly attached to a digital package (not shown) that is placed at the back of the display panel 1.

In the plasma display device of this first embodiment, a discharge start voltage estimation circuit 32 is so provided as to receive output signals of the temperature sensor 31. The discharge start voltage estimation circuit 32 stores data indicating the correlation between the temperature of the display panel 1 and the discharge start voltage as shown in FIG. 9. This data is the result of measurement that is carried out in advance, and stored in the discharge start voltage estimation circuit 32 in the manufacturing process of the plasma display device. By referring to FIG. 9, as the display panel 1 is higher in temperature, the discharge start voltage is also increased. The discharge start voltage estimation circuit 32 refers to the data of FIG. 9 to estimate the discharge start voltage of the display panel 1, and forwards the estimation result to a controller 29. Such voltage estimation is made based on the measurement result provided by the temperature sensor 31 as to the temperature of the display panel 1.

Figure 1:
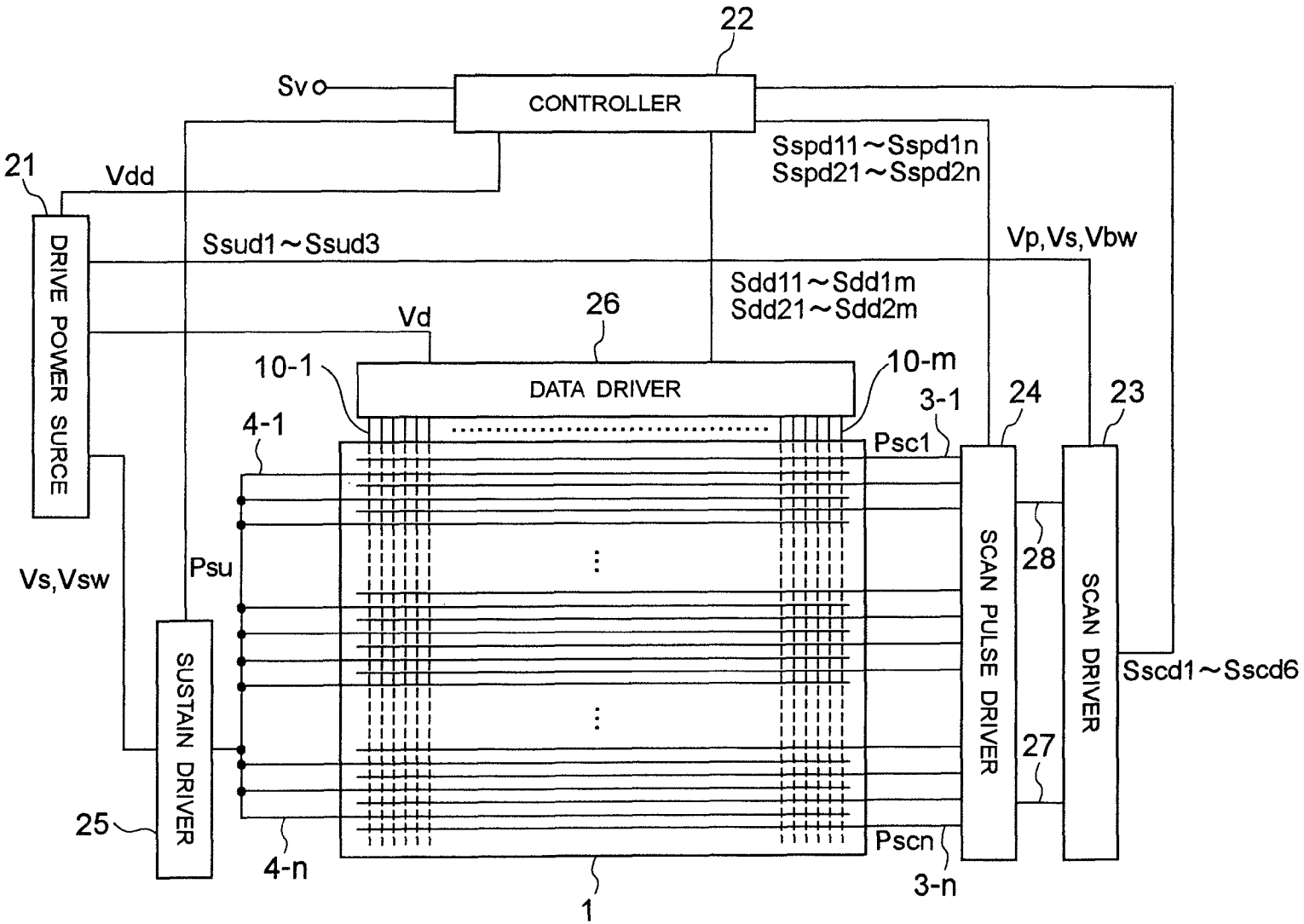
FIG. 1 is a block diagram showing a conventional AC-type plasma display device.

The controller 29 functions to calculate the time when the priming discharge will start, and control the sustain driver control signal Ssud2 based on thus calculated start time. Such time calculation is made based on the estimated value of the discharge start voltage provided by the discharge start voltage estimation circuit 32. Other than that, the controller 29 functions similar to the controller 22 (refer to FIG. 1) in the above-described conventional plasma display device. Moreover, the remaining configuration of the plasma display device of this first embodiment is similar to that of the conventional plasma display device of FIGS. 5 to 9, and any components similar to those in the conventional plasma display device are under the same reference numerals.

Figure 10:
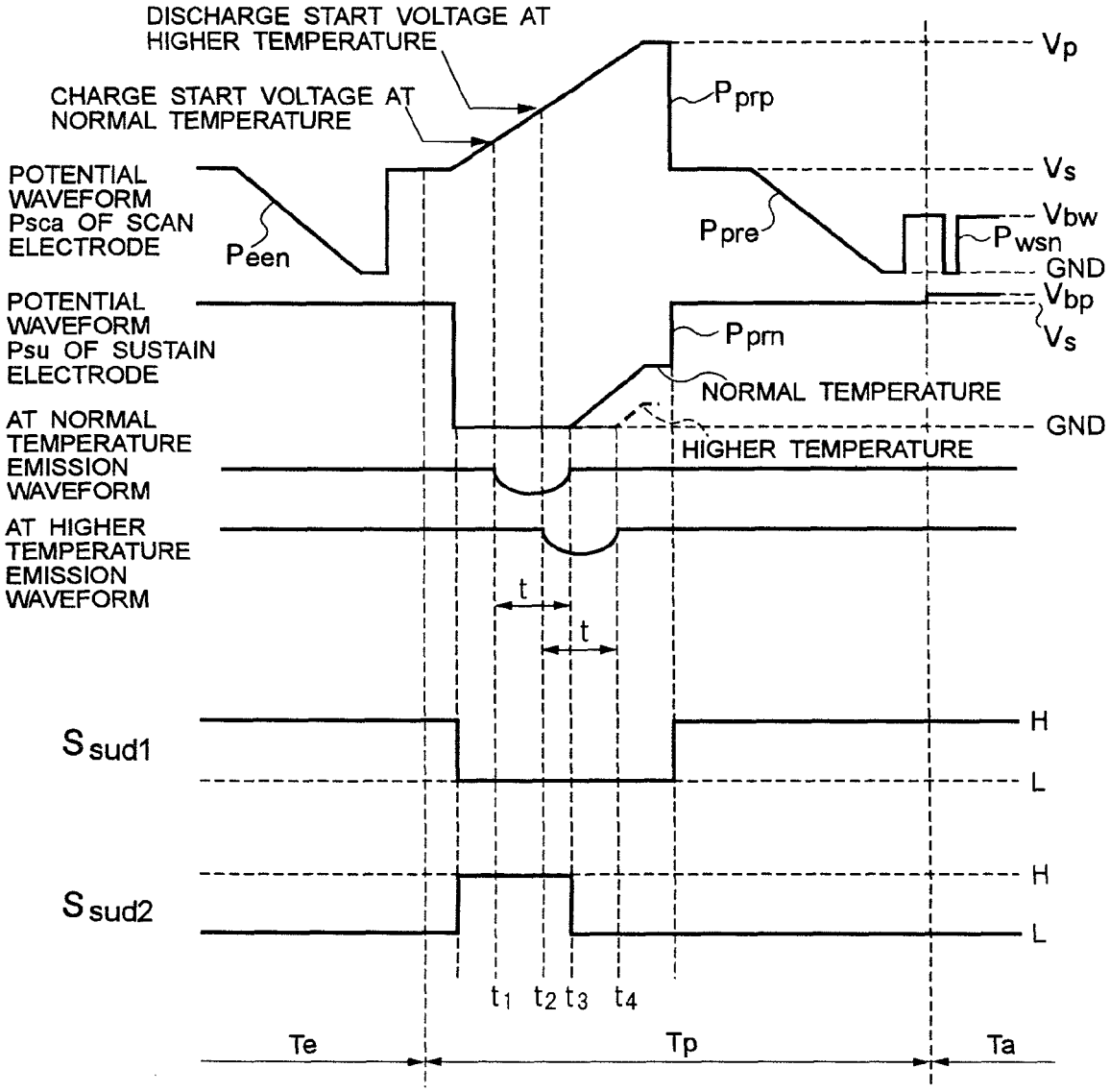
FIG. 10 is a timing chart showing the priming operation in the device of FIG. 8.

Described next is the operation of the plasma display device of this first embodiment configured as above, i.e., the method for driving the plasma display device of this embodiment. FIG. 10 is a timing chart showing the priming operation of the plasma display device of this embodiment.

By referring back to FIG. 8, during when the plasma display device is in operation, the measurement sensor 31 measures the temperature of the display panel 1, and the measurement result is forwarded to the discharge start voltage estimation circuit 32. The discharge start voltage estimation circuit 32 estimates the discharge start voltage, and outputs the estimated value to the controller 29. Such voltage estimation is made by referring to the measurement result provided by the temperature sensor 31 as to the temperature of the display panel 1, and the temperature-and-discharge-start-voltage correlation data of FIG. 9. The controller 29 then refers to thus provided estimation value and the waveform of the priming pulse Pprp of FIG. 10 to calculate the start time of the priming discharge. After the lapse of a predetermined time t from the start time, the sustain driver control signal Ssud2 is lowered in level from High to Low, and the sustain electrodes $\mathbf{4}_1$ to $\mathbf{4}_n$ are put into the floating state. In this manner, the priming discharge is stopped.

Considered here is a case, as indicated by solid lines in FIG. 10, where the PDP is at the normal temperature and the discharge start voltage takes a normal value, and the priming discharge starts at time t1. In this case, the temperature sensor 31 detects that the display panel 1 is at the normal temperature, the discharge start voltage estimation circuit 32 estimates that the discharge start voltage of the display panel 1 is at the normal value, and the controller 29 calculates that the priming discharge will start at a time t1. The controller 29 then falls the sustain driver control signal Ssud2 at a time t3 that is later than the time t1 by a predetermined time t so that the sustain electrode is put into the floating state to stop the priming discharge. In another exemplary case, as indicated by broken lines in FIG. 10, where the PDP temperature is high and the discharge start voltage takes a value higher than usual, the priming discharge starts at a t2 that is later than the time t1. In this case, the controller 29 rises the sustain driver control signal Ssud2 at a time t4 that is later than the time t2 by the predetermined time t to stop the priming discharge. That is, the higher temperature means the discharge start voltage being higher than the normal temperature, and the priming discharge is started at the time t2 that is later than the start time t1 for the normal temperature. Therefore, the sustain electrode is put into the floating state at the time t4 that is later than the time t3 for the normal temperature. In this manner, even if the temperature changes, the priming discharge can continue for the predetermined time t, enabling the priming discharge to be constant in intensity. That is, by adjusting the timing to put the sustain electrode into the floating state as above based on the estimated value of the discharge start voltage, the priming discharge shows less discharge duration difference between the case of normal temperature and that of higher temperature compared with a case where no such timing adjustment is made. Other than that, the plasma display device of this first embodiment operates similarly to the conventional plasma display device of FIG. 6.

In the first embodiment, the priming discharge can be controlled in duration even if the display panel 1 is changed in temperature due to a change of outside air temperature, heat generation as a result of driving the plasma display device, and others. Through such duration control, the priming discharge can be constant in intensity. The display cells through with priming discharge can be constant in the charge amount irrespective of the temperature, and thus the operation stability can be derived in the address period Ta and the sustain period Ts subsequent to the priming period Tp. This thus prevents the image contrast from lowering due to too much priming discharge with the normal temperature, and also prevents writing failures in the address period Ta due to insufficient priming discharge with the higher temperature, enabling the display quality to be excellent and stable.

In a case where the temperature sensor 31 is provided singly, the sensor is preferably placed at the back substrate of the display panel 1, i.e., at the center portion of the back surface of the insulation substrate 101. Described now is the reason thereof. Videos for display on the plasma display device mostly include those displayed entirely over the screen as television broadcast videos, and those displayed only at the corners of the screen as time display or function display. With the former videos, corresponding to video display, the temperature of the display panel 1 and the discharge start voltage are both increased almost uniformly. In consideration thereof, placing the temperature sensor 31 at the center portion of the display panel 1 enables to detect the typical temperature of the display panel 1, and to control the display panel 1 in such a manner as to cancel the increase of the discharge start voltage. With the latter videos, if displayed is a video illuminating only at a region at an end portion of the display panel 1, the region is heated but not the center portion of the display panel 1. The discharge start voltage is thus increased at the region and therearound, but not at the center portion of the display panel 1. As such, the discharge start voltage to be estimated by the discharge start voltage estimation circuit 32 does not reflect the increase of the discharge start voltage at the region. With such local illumination, the load required to drive the display panel 1 is small, and thus the data electrode is not reduced in voltage that much. This accordingly increases the application voltage at writing discharge compared with a case where the load is large as with the entire-screen illumination. With this being the case, the increase of the discharge start voltage at the region can be compensated to some extent. For both such entire-screen illumination videos and local illumination videos, measuring the temperature of the display panel 1 at the center portion of the back surface of the display panel 101 allows control application to cancel the change of discharge start voltage to a practically useful degree.

In an alternative configuration, the temperature sensor 31 may be plurally provided at the back substrate of the display panel 1, and the measurement results derived by these temperature sensors may be used as a basis to control voltage application over the scan electrodes and the sustain electrodes. If this is the case, the above voltage application control may be exercised based on the average or maximum value of the measurement results derived by those temperature sensors. Using a weighted average of the measurement results for the purpose is also a possibility with the positions of the temperature sensors considered.

Note here that FIG. 10 shows only two cases with the normal temperature (solid lines) and the higher temperature (broken lines). In this first embodiment, however, it is possible to successively change the timing to fall the timing the sustain driver control signal Ssud2 in accordance with the temperature.

Described next is a second embodiment of the present invention. Similarly to the first embodiment, a plasma display device of this second embodiment is provided with the temperature sensor 31 and the discharge start voltage estimation circuit 32 of FIG. 8. In the second embodiment, the controller 29 functions to control a gate voltage in such a manner that the priming discharge always starts at the time t1 in the priming period Tp based on the estimation result derived by the discharge start voltage estimation circuit 32. Herein, the gate voltage is for application to a resistance element (not shown) configured by a field-effect transistor, which is connected between the switch $\mathbf{23}_1$ (refer to FIG. 2) and a node (not shown) for receiving the priming voltage Vp. Other than that, the controller 29 functions similar to the controller 22 (refer to FIG. 1) in the above-described conventional plasma display device. Moreover, the remaining configuration of the plasma display device of this second embodiment is similar to that of the plasma display device of the first embodiment (refer to FIG. 8).

Figure 11:
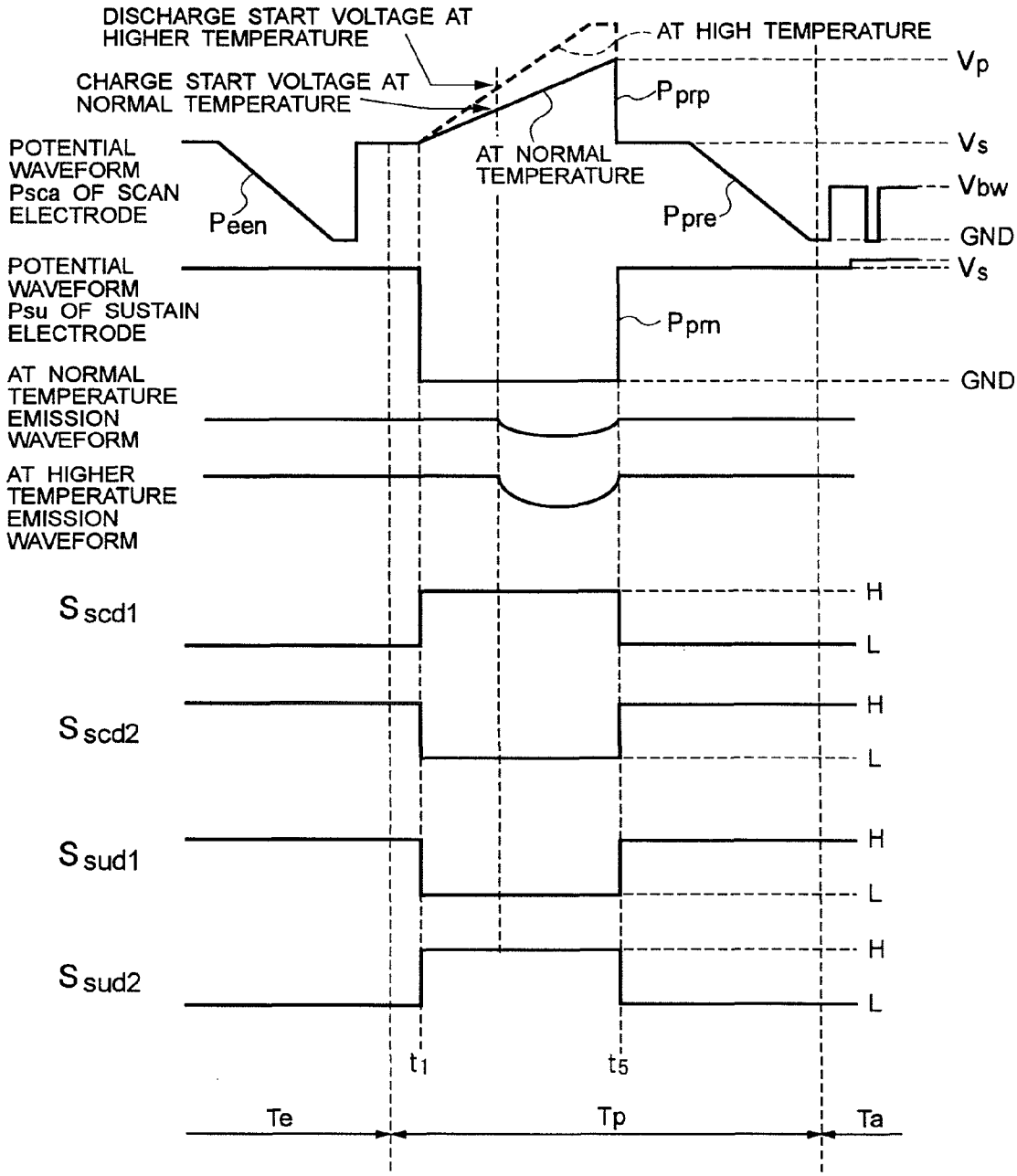
FIG. 11 is a timing chart showing the priming operation of another exemplary plasma display device of the present invention.

Described next is the operation of the plasma display device of this second embodiment configured as above, i.e., the method for driving the plasma display device of this embodiment. FIG. 11 is a timing chart showing the priming operation of the plasma display device of this embodiment.

By referring back to FIG. 8, during when the plasma display device is in operation, the measurement sensor 31 measures the temperature of the display panel 1, and the measurement result is forwarded to the discharge start voltage estimation circuit 32. The discharge start voltage estimation circuit 32 estimates the discharge start voltage, and outputs the estimated value to the controller 29. Such voltage estimation is made based on the measurement result provided by the temperature sensor 31.

Figure 2:
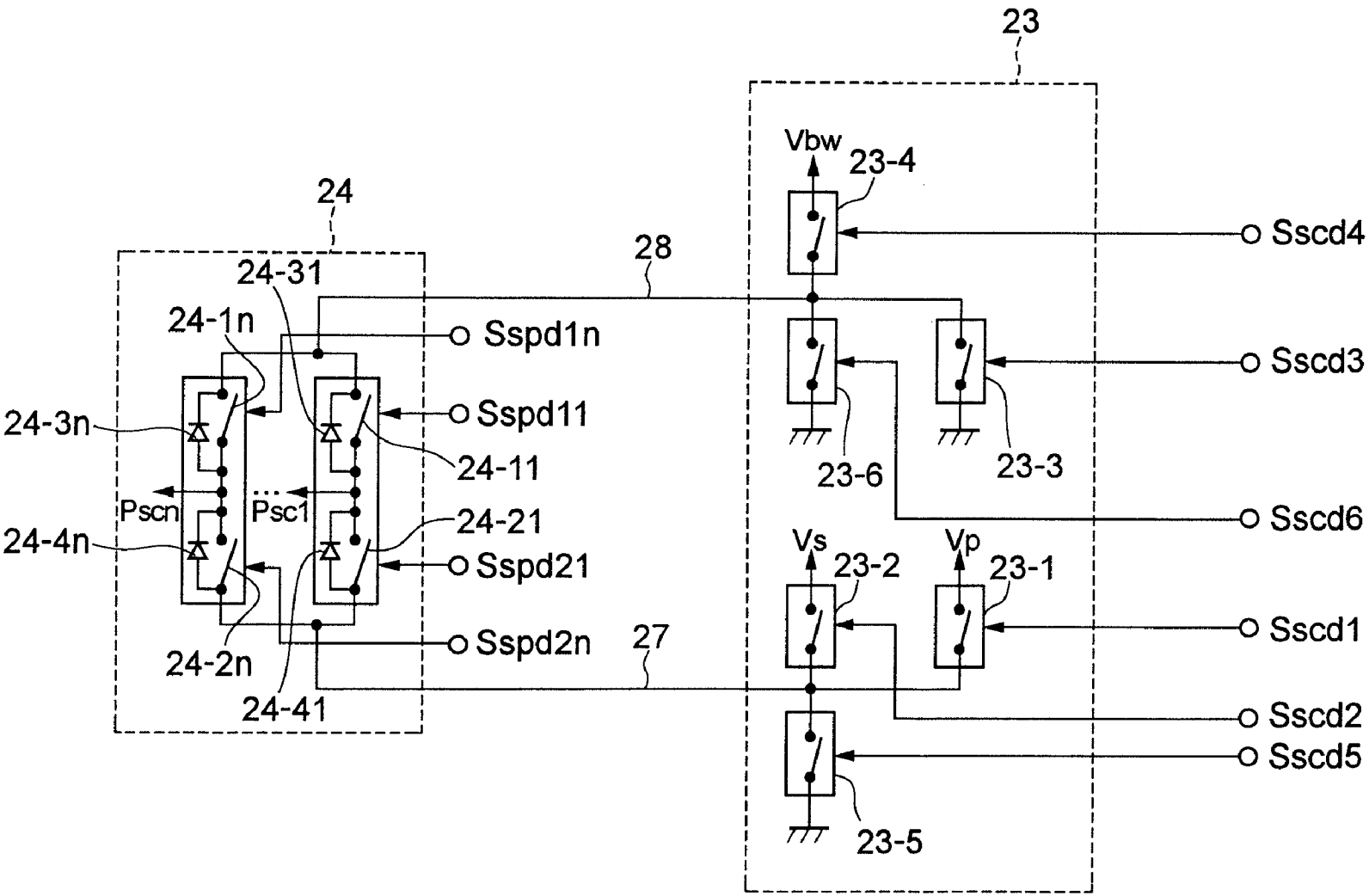
FIG. 2 is a circuit diagram showing a scan driver and a scan pulse driver in the device of FIG. 1.
Figure 3:
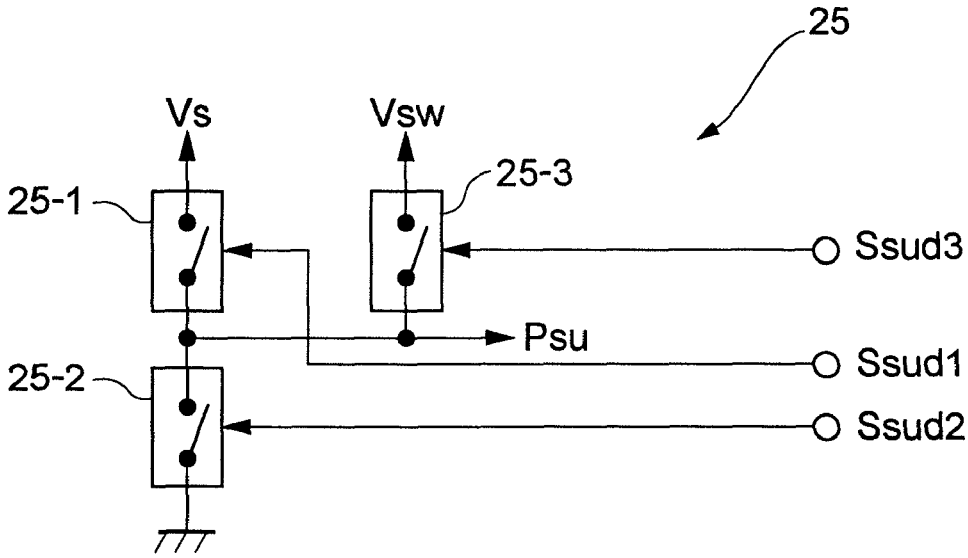
FIG. 3 is a circuit diagram showing a sustain driver in the device of FIG. 1.
Figure 4:
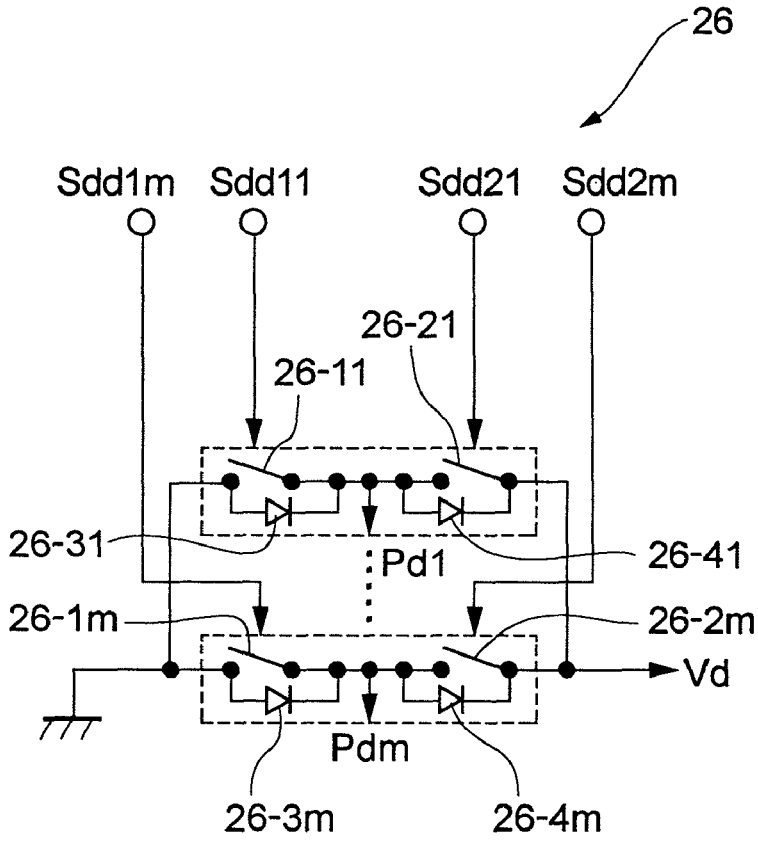
FIG. 4 is a circuit diagram showing a data driver in the device of FIG. 1.

As shown in FIG. 11, based on the estimated value of the discharge start voltage, the controller 29 (refer to FIG. 8) controls the gate voltage of the field-effect transistor connected to the switch $\mathbf{23}_1$ (refer to FIG. 2). The controller 29 then goes through slope adjustment in such a manner that the priming discharge always starts at the time t1. More specifically, the controller 29 adjusts the slope for the part where the potential at the priming pulse Pprp is increased from the sustain voltage Vs to the priming voltage Vp. Such a slope is hereinafter simply referred to as slope of the priming pulse Pprp.

After causing the potential of the scan electrode reach the priming voltage Vp, the controller 29 falls the scan driver control signal Sscd1 in level from High to Low at a time t5, rises the scan driver control signal Sscd2 in level from Low to High, and rises the sustain driver control signal Ssud1 in level from Low to High. At the same time, the controller 29 falls the sustain driver control signal Ssud2 in level from High to Low. Such level change reduces the potential of the scan electrode from the priming voltage Vp to the sustain voltage Vs, and at the same time, the potential of the sustain electrode is increased from the ground voltage GND to the sustain voltage Vs. That is, the sustain electrode is not put into the floating state, and the negative priming pulse Pprn becomes rectangular. The priming discharge stops responsively when the sustain driver control signal Ssud2 is changed in level from High to Low.

As exemplarily indicated by solid lines in FIG. 11, when the discharge start voltage takes a normal value with the normal temperature, the controller 29 regards the slope of the priming pulse Pprp as normal. At this time, the priming discharge starts at the time t1. At the time t5, the controller 29 then rises the sustain driver control signal Ssud2 to stop the priming discharge. On the other hand, as exemplarily indicated by broken lines in FIG. 12, when the discharge start voltage is higher than usual with the higher temperature, the controller 29 regards the slope of the priming pulse Pprp as steeper than usual. The priming discharge thus starts at the time t1. At the time t5, the controller 29 then rises the sustain driver control signal Ssud2 to stop the priming discharge. In this manner, even with varying temperature, the priming discharge will always start at the time t1, will continue for the same duration, i.e., from the time t1 to t5, and will be the same in intensity. Other than that, the operation of the plasma display device of this embodiment is similar to that of the plasma display device of the first embodiment.

In the second embodiment, the priming discharge can continue for the same duration no matter if the display panel is changed in temperature. This enables to make uniform the charge amount in the display cells after priming discharge even if the display panel is changed in temperature. This thus prevents the image contrast from lowering due to too much priming discharge with the normal temperature, and also prevents writing failures in the address period Ta due to insufficient priming discharge with the higher temperature, enabling the display quality to be excellent and stable even with varying temperature of the display panel.

In the above-described first embodiment, when the display panel is changed in temperature, the discharge occurring between the scan electrodes and the sustain electrodes as a part of priming discharge (hereinafter, referred to as surface discharge) can be made uniform. At the time of priming discharge, however, a slight discharge is occurring between the scan electrodes and the data electrodes (hereinafter, referred to as opposing discharge), and this opposing discharge shows a change in response to a change of the discharge start voltage. Thus, also in the first embodiment, a change of the discharge start voltage affects the priming discharge although only slightly.

In the second embodiment, on the other hand, because the voltage between the scan electrodes and the data electrodes is also adjusted in accordance with the discharge start voltage, not only the surface discharge but also the opposing discharge can be made uniform. This favorably can stabilize the priming discharge to a greater degree.

Note here that FIG. 11 shows only two cases with the normal temperature (solid lines) and the higher temperature (broken lines). In this second embodiment, however, it is possible to successively change the slope of the priming pulse Pprp in accordance with the temperature.

Figure 12:
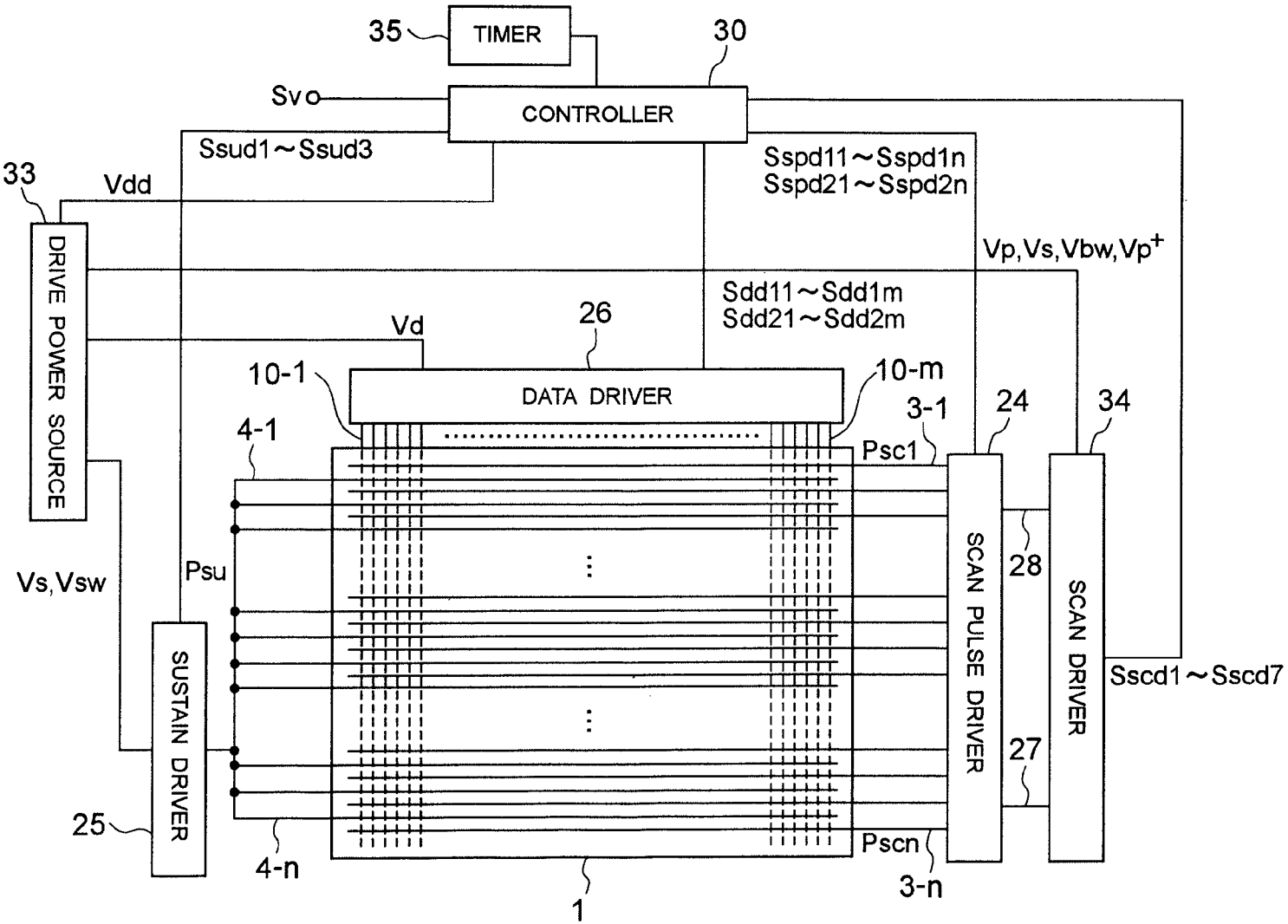
FIG. 12 is a block diagram showing still another exemplary plasma display device of the present invention.
Figure 13:
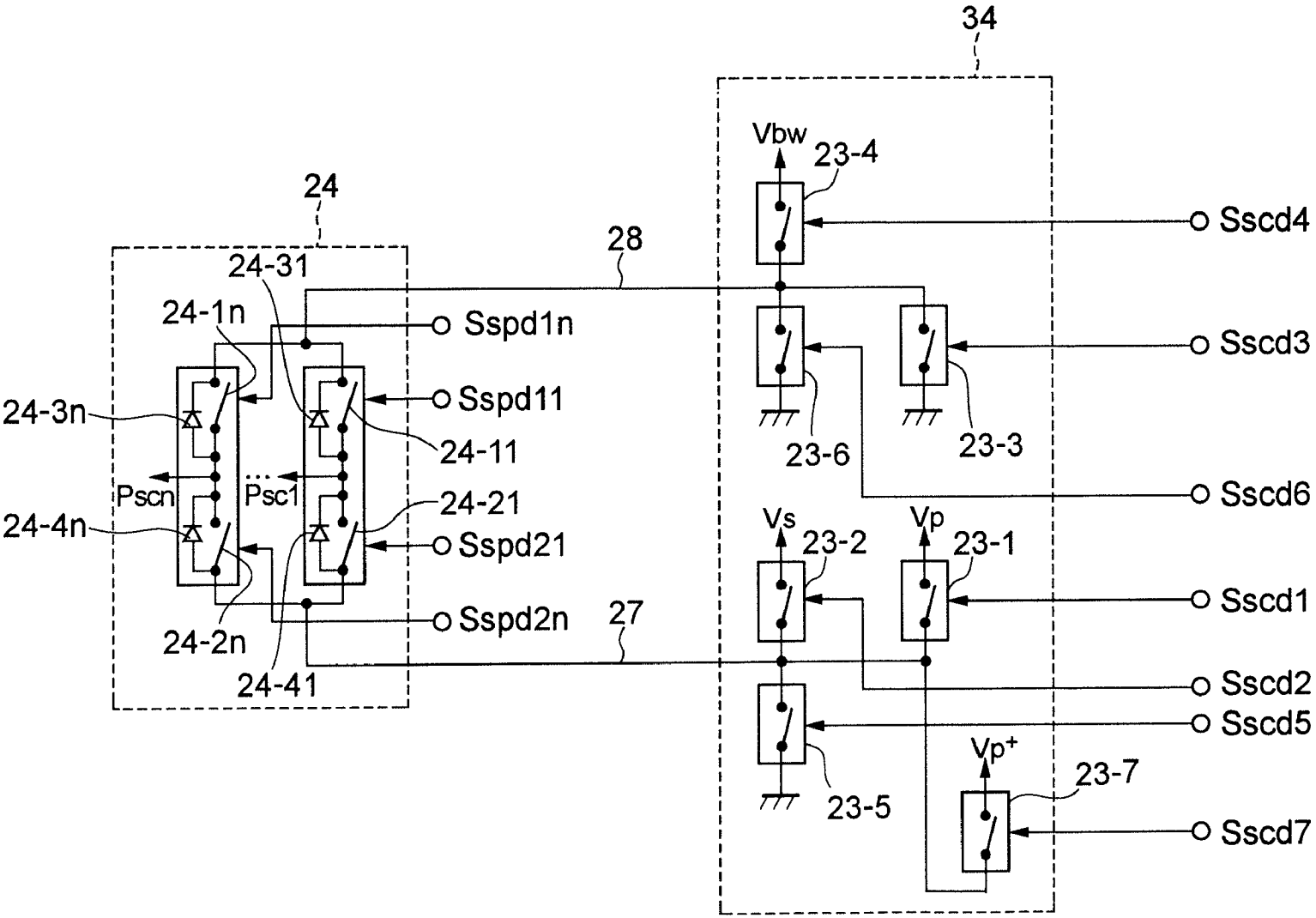
FIG. 13 is a circuit diagram showing a scan driver and a scan pulse driver in the device of FIG. 12.

Described next is a third embodiment of the present invention. FIG. 12 is a block diagram showing a plasma display device of this embodiment, and FIG. 13 is a circuit diagram showing a scan driver and a scan pulse driver of FIG. 12. As shown in FIG. 12, a plasma display device of this second embodiment is provided with a controller 30 as a replacement of the controller 29 in the plasma display device of the above-described first embodiment (refer to FIG. 8). Similarly, a drive power source 33 is a replacement of the drive power source 21, and a scan driver 34 is a replacement of the scan driver 23. What is more, the plasma display device of the third embodiment is provided with a timer 35, serving as a start-up detection circuit connected to the controller 30.

The drive power source 33 supplies two types of priming voltages, i.e., Vp and Vp+, to the scan driver 34. The priming voltage Vp+ is higher than the priming voltage Vp. Other than that, the driver power source 33 functions similarly to the drive power source 21 in the first embodiment.

The timer 35 is so configured as to receive the logic voltage Vdd from the driver power source 33. The timer 35 measures the time after the plasma display device is turned ON, and outputs high-level signals to the controller 30 for a predetermined duration after the power is turned ON, e.g., a few seconds. Thereafter, the timer 35 outputs low-level signals. That is, the timer 35 serves as a start-up detection circuit, detecting whether a predetermined duration is passed or not after the drive circuit is turned ON. The predetermined duration is set in advance to be longer than the time taken for the discharge start voltage to be reduced to its normal value after the plasma display device is started up, and after the display cells are activated.

As shown in FIG. 13, the scan driver 34 is provided with a switch $\mathbf{23}_7$ in addition to the switches $\mathbf{23}_1$ to $\mathbf{23}_6$. The switch $\mathbf{23}_7$ receives the priming voltage VP+ at one end, and the other end thereof is connected to the positive line 27. Other than that, the remaining configuration of the scan driver 34 is similar to that of the scan driver 23 in the first embodiment.

To the scan driver 34, the controller 30 forwards a scan driver control signal Sscd7 in addition to the scan driver control signals Sscd1 to Sscd6. The scan driver control signal Sscd7 is provided to the switch $\mathbf{23}_7$ of the scan driver 34, and controls the ON/OFF operation of the switch $\mathbf{23}_7$.

The controller 30 estimates the discharge start voltage based on the signals coming from the timer 35, and exercises control over the waveform of the priming pulse Pprp. In more detail, when the signals coming from the timer 35 are low in level, the controller 30 regards the waveform of the priming pulse Pprp the same as that for the conventional plasma display device. At this time, the priming pulse Pprp reaches the priming voltage Vp. When the signals coming from the timer 35 are high in level, at the time of generating the priming pulse Pprp, the controller 30 lengthens the duration of the priming pulse Pprp in the following manner. That is, while maintaining the scan driver control signal Sscd1 at Low level, the controller 30 rises the level of the scan driver control signal Sscd7 so that the priming pulse Pprp reaches the priming voltage Vp+. The controller 30 also applies timing control to the scan driver control signals Sscd7 and Sscd2, and the sustain driver control signals Ssud1 and Ssud2. Other than that, the controller 30 functions similar to the controller 22 (refer to FIG. 1) in the above-described conventional plasma display device. Moreover, the remaining configuration of the plasma display device of this first embodiment is similar to that of the conventional plasma display device of FIGS. 1 to 5.

Figure 14:
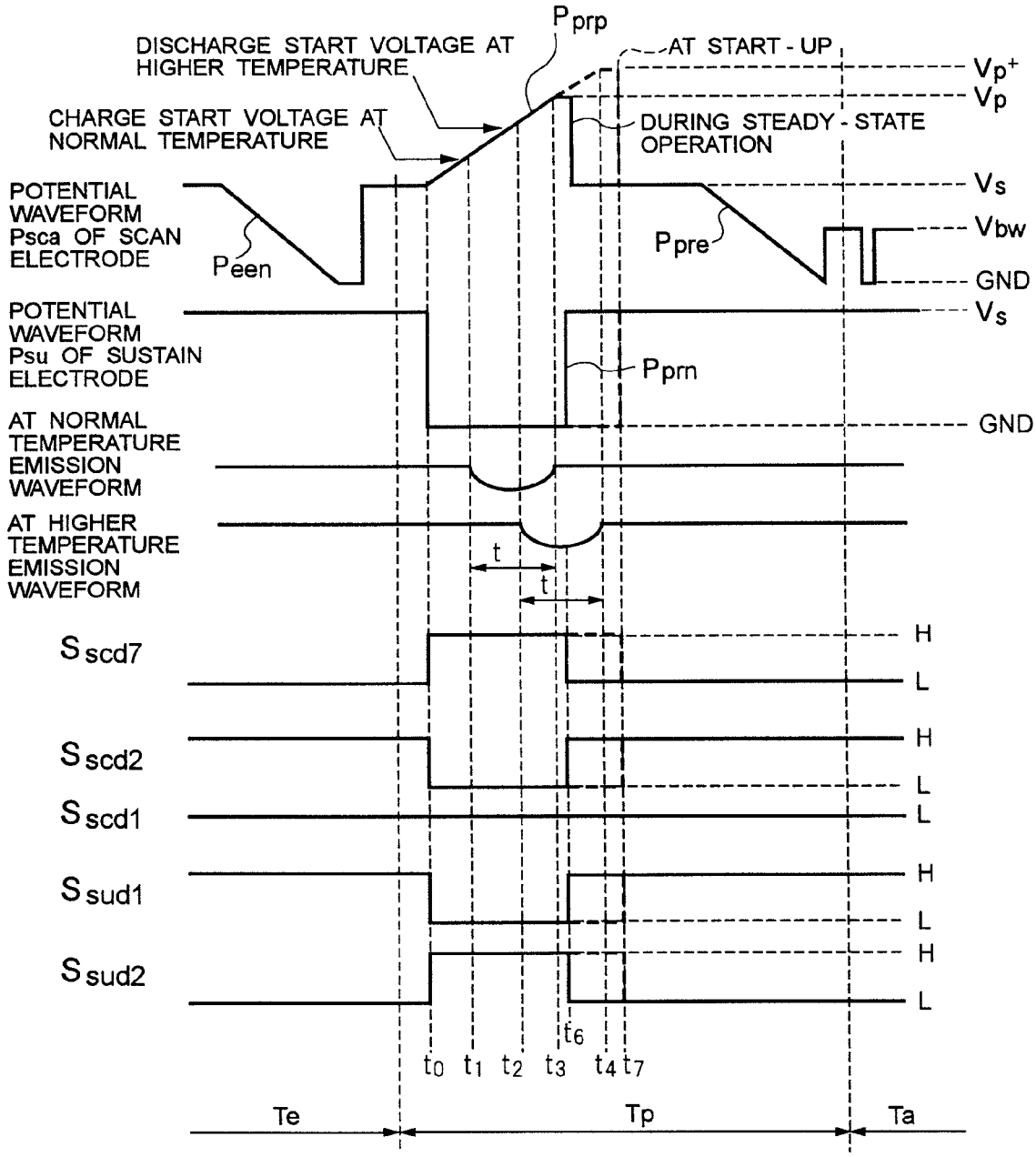
FIG. 14 is a timing chart showing the priming operation of the device of FIG. 12.

Described next is the operation of the plasma display device of this third embodiment configured as above, i.e., the method for driving the plasma display device of this embodiment. FIG. 14 is a timing chart showing the priming operation of the plasma display device of this embodiment.

Described first is the operation at start-up of the plasma display device, i.e., the operation in a period when the output signals coming from the timer 35 are high in level. As shown in FIG. 12, when the plasma display device having been in the stopped state is activated, the drive power source 33 is activated, and supplies the logic voltage Vdd to the timer 35. In response, the timer 35 starts time measurement, and outputs high-level signals to the controller 30. The controller 30 displays on the display panel 1 images based on the video signal Sv.

When the output signals coming from the timer 35 are high in level, as shown in FIG. 14, the controller 30 changes the level of control signals at a predetermined time t0 in the priming period Tp. That is, while maintaining the scan driver control signal Sscd1 low in level, the controller 30 changes the level of the scan driver control signal Sscd7 from Low to High, and the level of the scan driver control signal Sscd2 from High to Low. As a result, the scan electrodes receive the priming pulse Pprp being the saw tooth pulse of the priming voltage Vp+. At the time t0, the controller 30 changes the level of the sustain driver control signal Ssud1 from High to Low, and the level of the sustain driver control signal Ssud2 from Low to High. This reduces the potential of the sustain electrodes from the sustain voltage Vs to the ground voltage GND, and the negative priming pulse Ppm is started.

As described in the foregoing, the discharge start voltage is high at start-up of the plasma display device. Accordingly, the priming discharge starts at the time t2, and spontaneously stops at the time t4 that is later than the time t2 by the predetermined time t.

As indicated by broken lines in FIG. 14, at a time t7 later than the time t4, the scan driver control signal Sscd7 is lowered in level from High to Low, and the scan driver control signal Sscd2 is raised in level from Low to High. This reduces the potential of the scan electrodes from the priming voltage Vp+ to the sustain voltage Vs, and the priming pulse Pprp is thus ended. Also at the time t7, the sustain driver control signal Ssud1 is raised in level from Low to High, and the sustain driver control signal Ssud2 is lowered in level from High to Low. This increases the potential of the sustain electrodes from the ground voltage GND to the sustain voltage Vs, and the priming pulse Pprp is thus ended. Herein, estimating the discharge start voltage at start-up of the plasma display device allows estimation of the discharge start time t2. Accordingly, the discharge end time t4 can be also estimated so that the time t7 can be so set as to be later than the time t4.

With some time lapse after the plasma display device is started up, the discharge gas in the display cells is activated, and the discharge start voltage is thus reduced. For a predetermined duration after the start-up of the plasma display device, e.g., a few seconds, the output signals from the timer 35 are lowered in level from High to Low. At this point in time, the discharge start voltage is already reduced to the normal value.

Described next is the steady-state operation, i.e., the operation in a period when the output signals from the timer 35 are low in level. As shown in FIG. 14, the operation at the predetermined time t0 in the priming period Tp is the same as the abode-described operation at start-up of the plasma display device. That is, at the time t0, the controller 30 rises the scan driver control signal Sscd7, and lowers the scan driver control signal Sscd2 to start the priming pulse Pprp. The controller 30 also lowers the sustain driver control signal Ssud1, and rises the sustain driver control signal Ssud2 to start the priming pulse Pprn.

At this point in time, the plasma display device is already in its steady-state operation, and the discharge start voltage is at the normal value. Accordingly, the priming discharge starts at the time t1, and stops spontaneously at the time t3 that is later than the time t1 by the predetermined time t.

As indicated by solid lines in FIG. 14, at the time t6 that is later than the time t3 but earlier than the time t4, the scan driver control signal Sscd7 is lowered, and the scan driver control signal Sscd2 is raised. This reduces the potential of the scan electrodes from the priming voltage Vp+ to the sustain voltage Vs, and the priming pulse Pprp is thus ended. At the time t6, the sustain driver control signal Ssud1 is raised, and the sustain driver control signal Ssud2 is lowered. This increases the potential of the sustain electrodes from the ground voltage GND to the sustain voltage Vs, and the priming pulse Ppm is thus ended. Herein, estimating the discharge start voltage during the steady-state operation of the plasma display device allows estimation of the discharge start time t1. Accordingly, the discharge start time t3 can be also estimated so that the discharge end time t6 can be so set as to be later than the time t3.

In such a manner, no matter whether the plasma display device is at start-up or in the steady-state operation, the priming discharge can continue for the predetermined length of time t, thereby enabling the priming discharge to be constant in intensity. Other than that, the operation of the plasma display device of the third embodiment is similar to that of the conventional plasma display device of FIG. 6.

In this third embodiment, at start-up of the plasma display device, the duration of the priming pulses Pprp and Ppm is lengthened than in the steady-state operation, and the potential of the priming pulse Pprp is made higher than that in the steady-state operation. More specifically, the discharge start voltage at device start-up is higher than that in the steady-state operation, and the start time t2 for the priming discharge is later than the start time t1 under the normal temperature. Thus, a transition time t7 is set later than a transition time t6 during the steady-state operation. Here, at the transition time t7, period transition is made from the period for consecutively increasing the potential difference between the scan electrodes and the sustain electrodes to the period for decreasing the potential difference. With such a transition time setting, the priming discharge is prevented from varying in duration even if the priming start voltage is increased at device start-up, enabling the priming discharge to be constant in intensity. The display cells can be prevented from varying in charge amount both at device start-up and in the steady-state operation. This thus prevents writing failures in the address period Ta due to insufficient priming discharge at device start-up, and also prevents the image contrast from lowering due to too much priming discharge in the steady-state operation, enabling the display quality to be excellent and stable.

The time for lowering from High to Low the level of the output signals coming from the timer 35 is so set as to be later after the display cells are activated therein, and the discharge start voltage is reduced to the normal value. Accordingly, during the time before the output signals coming from the timer 35 to be lowered after the discharge start voltage is reduced to the normal value, the black level is raised, and thus the image contrast is reduced. However, this is merely a few seconds after the plasma display device is started up, and this thus does not annoy viewers. Alternatively, during the time when the output signals from the timer 35 are high in level, the display panel 1 may display black instead of displaying images based on the video signal Sv.

Exemplified in the above-described first and second embodiments is the case of adjusting the waveform of a priming pulse based on the temperature to make the discharge start voltage insensitive to the temperature change. Exemplified in the third embodiment is the case of adjusting the waveform of a priming pulse at start-up of the plasma display device to eliminate the influence caused by the discharge start voltage that is increased at start-up. The present invention is not restrictive to such embodiments, and alternatively, the plasma display device may be provided with a timer or others to eliminate the influence caused by the discharge start voltage that varies at start-up in the first and second embodiments. And in the third embodiment, the plasma display device may be provided with a temperature sensor and a discharge start voltage estimation circuit to eliminate the influence of the varying discharge start voltage due to the temperature change. Still alternatively, in the first to third embodiments, the influence of variation at start-up and the influence of variation resulted from the temperature may be both eliminated.

Further, at least two out of the first to third embodiments may be combined together for application. For example, in the first embodiment (refer to FIG. 3), as described above, the sustain electrodes may not be put into the floating state by adjusting the timing to lower the sustain driver control signal Ssud2 in level based on the temperature. Also at start-up of the plasma display device, the sustain driver control signal Ssud1 may be raised, and simultaneously therewith, the sustain driver control signal Ssud2 may be lowered. At this tine, using the technology of the third embodiment (refer to FIG. 7), at start-up of the plasma display device, the duration of the priming pulse may be set longer than that in the steady-state operation, and the potential may be increased. This enables the display quality to be excellent and stable to a greater degree.

Still further, exemplified in the above embodiments is the case of making the duration of priming discharge uniform when the discharge start voltage varies. In the present invention, the duration of priming discharge is not necessarily be strictly constant, and may be so controlled as to be the level making the charge amount uniform in the display cell after priming discharge.

Still further, exemplified in the above embodiments is the case of configuring a field by a plurality of subfields, and providing a priming period to each of the subfields. This is not restrictive, and in the present invention, one or more subfields are selected from a field for provision of a priming period. Alternatively, only a subfield out of those of a predetermined number of fields may be provided with a priming period. By reducing the number of priming periods as such, the black level is reduced, and the image contrast can be improved. The present invention serves effective to all of the above cases.

The present invention is applicable to AC discharge plasma display devices for use in large-and-thin television receivers.

Although described in this specification is about the write-select drive mode, the present invention is surely applicable to the deletion-select drive mode. More specifically, the present invention is applicable to such a drive mode that deletion selection is made instead of write selection in the address period Ta. This deletion selection is made from the state in which every discharge cell is formed with a wall charge after application of the priming removal pulse Ppre is stopped in the priming period Tp of FIG. 13, or utilizing the pulse application for charge adjustment. This is because the display quality can be excellent and stable also with such a deletion-select mode by making the charge state constant in the display cells after the priming period.

This application is based on a Japanese Application No. 2004 119544 which is hereby incorporated by reference.

What is claimed is:

1. A drive method for a plasma display device comprising a display panel provided with scan electrodes, sustain electrodes, and data electrodes so as to form a plurality of display cells, wherein a field is divided into one or more subfields for display, and in at least one of the subfields, a priming period is provided to cause priming discharge to activate a charge state, comprising the steps of:

detecting a temperature of the display panel; and changing a waveform of a voltage applied to at least one electrodes of the scan electrodes and the sustain electrodes between a first case with a first detected value of the display panel temperature and a second case with a second detected value which is smaller than the first detected value.

2. The drive method for the plasma display device according to claim 1, wherein a first period for increasing a difference in potential between the scan electrodes and the sustain electrodes with time, and a second period for decreasing the potential difference with time are provided in the priming period, and a ratio of the increase in the first period of the first case is larger than that in the second case.

3. The drive method for the plasma display device according to claim 2, wherein in the first period of the priming period, a potential of the sustain electrodes is maintained to a first potential, and a potential of the scan electrodes is increased from a second potential which is higher than the first potential with time to reach a third potential, and in the second period, the potential of the scan electrodes is decreased with time to reach a fifth potential after decreasing to a fourth potential which is lower than the third potential and the potential of the sustain electrodes is increased from the first potential to a sixth potential.

4. A drive method for a plasma display device comprising a display panel provided with scan electrodes, sustain electrodes, and data electrodes so as to form a plurality of display cells, wherein a field is divided into one or more subfields for display, and in at least one of the subfields, a priming period is provided to cause priming discharge to activate a charge state, wherein a first period for increasing a difference in potential between the scan electrodes and the sustain electrodes with time, and a second period for decreasing the potential difference with time are provided in the priming period, and wherein a maximum value of a difference in potential between the scan electrodes and the sustain electrodes in the first period for a predetermined time after start-up is larger than that after the predetermined time.

5. The drive method for the plasma display device according to claim 4, wherein in the first period of the priming period, a potential of the sustain electrodes is maintained to a first potential, and a potential of the scan electrodes is increased from a second potential which is higher than the first potential with time to reach a third potential.

* * * * *